US007507137B1

(12) United States Patent
Rouse

(10) Patent No.: US 7,507,137 B1
(45) Date of Patent: Mar. 24, 2009

(54) ADVANCED APERTURE FRAMEWORK BALLOON DISPLAY

(76) Inventor: Graham Manly Rouse, 430 Queen St., Columbia, SC (US) 29205

( * ) Notice: Subject to any disclaimer, the term of this patent is extended or adjusted under 35 U.S.C. 154(b) by 0 days.

(21) Appl. No.: 09/542,674

(22) Filed: Apr. 1, 2000

(51) Int. Cl.
*A63H 3/06* (2006.01)

(52) U.S. Cl. ..... 446/220; 446/221; 446/223; 428/9; 428/12; 472/134

(58) Field of Classification Search ..... 446/220–223, 446/224, 225, 226; 428/9, 12
See application file for complete search history.

(56) References Cited

U.S. PATENT DOCUMENTS 1,658,275 A * 2/1928 Wright ..... 40/618
1,718,458 A * 6/1929 Hager et al. ..... 42/144
1,781,458 A * 3/1930 Gore ..... 24/135 R
2,470,990 A * 5/1949 Kennedy ..... 446/220
4,155,552 A * 5/1979 Jacobo et al. ..... 273/380
4,941,856 A * 7/1990 Lovik ..... 446/220
5,141,463 A * 8/1992 Rouse, Jr. ..... 446/221
5,199,200 A * 4/1993 Howell ..... 40/799
5,533,285 A * 7/1996 Skistimas ..... 40/584
5,675,922 A * 10/1997 Skistimas ..... 40/584

* cited by examiner

*Primary Examiner*—Sana Al-Hashemi

(57) ABSTRACT

A balloon display comprised of at least one or at least two frameworks as specified in different embodiments. Each framework has apertures that circumscribe inflatable chambers. The inflatable chambers are arranged in at least one or at least two layers as specified in different embodiments. The inflatable chambers are secured in the apertures by any of a variety of means specified. Elements of the display may be arranged in a variety of relationships to one another as specified. Elements of the display are connected by any of a variety of means specified. The display is designed for viewing in any of a variety of directions specified in different embodiments.

20 Claims, 10 Drawing Sheets

ADVANCED APERTURE FRAMEWORK BALLOON DISPLAY

FIELD OF THE INVENTION

This invention relates to decorative designs utilizing balloons held in the apertures of frameworks.

BRIEF BACKGROUND OF THE INVENTION

A. General

There are a large variety of balloon display systems currently utilized for making balloon displays. The use of mechanical connections and of adhesives and multi part connectors to anchor balloons to structures, frameworks and to each other is not unusual. We call this approach "Anchor Frameworks". The use of frameworks which hold balloons within openings in the plane of the frameworks has also become commonplace. We call this approach "Aperture Frameworks".

B. Anchor Frameworks

Anchoring balloons to some structure or framework is probably among the oldest of display systems.

1. Description a. Balloons are frequently connected by their stems directly to flexible lines or to more rigid wires, rods, columns, sheets, grids etc. Most such display systems show off the tops of balloons and many reveal the anchored stems as part of the displays.

b. The use of adhesives to connect balloons to structures, frameworks and to each other is also not unusual. A single balloon is normally stuck to an adjacent object at only one or two points or small areas at once. Balloons may be stuck to the same object, or framework, or may be stuck to each other in a series or in a three dimensional array to create an adhesive connected balloon display.

c. Multi Part anchors are also normal. For instance, paper clips are sometimes connected to the lips of balloons and then to a structure. Occasionally, adhesive is used to connect hook & loop fasteners such as Velcro® to balloons. The matching hook (or loop) section of Velcro® is stuck to the structure and then the hook and loop sections are joined. It is also not unusual for monofilament (fishing) line to be tied to the neck of balloons and then tied to some additional structure.

2. Benefits a. Most anchors are secure and hold balloons in place even after balloons begin to shrink.

b. Anchor methods allow for the use of a very wide range of structures and supplies which are generally available from local vendors.

c. Anchor framework balloon displays usually allow a wide range of choice as to the level of inflation and thus the color quality of balloons being used.

C. Aperture Frameworks

Frameworks which hold balloons within apertures in the same plane as the framework have been around since at least 1983.

1. Description a. These aperture frameworks have consistently used only pneumatic pressure of the balloon expanding outward against the sides of the aperture as the mechanism to hold balloons in place.

b. These aperture frameworks have consisted of a single layer of balloons held within the single, flat plane of the framework and apertures.

c. These aperture frameworks have been designed with the plane of the apertures the same as the plane of the overall framework d. These aperture frameworks have been designed for the balloon display to be viewed from angles centered on a line perpendicular to the plane of the framework which is also a line perpendicular to the plane of the apertures.

e. These aperture frameworks are frequently designed to be connected together by a separate mechanism into larger display units 2. Benefits a. Aperture frameworks commonly use only one layer of balloons to create graphics. This can produce considerable savings in balloons and in space required for the display.

b. Aperture frameworks balloon displays often allow for the display to be viewed from both front and back with a single layer of balloons.

c. Aperture framework balloon displays frequently display balloons with a "side" view, hiding the stem and the dark spot which otherwise often shows on the opposite end of the balloon.

BRIEF SUMMARY OF THE INVENTION

Advanced Aperture Frameworks

This invention creates Advanced Aperture Frameworks with significant practical and esthetic benefits over previous systems.

1. Description a. This invention teaches the use of standard anchor framework techniques to hold balloons within the plane of aperture frameworks.

b. This invention teaches the use of multiple layer aperture frameworks.

c. This invention teaches the use of aperture frameworks in which the plane of apertures is not the same as the plane of the overall framework.

d. This invention teaches the use of aperture frameworks which are intended to be viewed from angles not generally centered on a line perpendicular to the plane of the overall framework.

e. This invention teaches the use of aperture frameworks which are intended to be viewed from angles not generally centered on a line perpendicular to the plane of the apertures.

f. This invention teaches the use of apertures which are framed in more than one plane, including non-parallel planes.

g. This invention teaches the use of aperture frameworks which extend in more than one plane, including non-parallel planes.

h. This invention teaches the use of apertures which are framed in non-planar (essentially not flat) ways.

i. This invention teaches the use of aperture frameworks which are non-planar (essentially not flat).

j. This invention teaches the use of aperture "gates" in the frame of the aperture.

k. This invention teaches the use of the balloons in the display as mechanisms to connect aperture frameworks together into larger units.

l. This invention teaches the use of adjustable aperture frameworks that allow the framework to be readily disassembled and reassembled in new configurations.

m. This invention teaches the use of combinations of these advanced aperture characteristics.

2. Benefits a. Advanced aperture framework balloon displays often take advantage of the basic benefits of aperture frameworks Efficiency of balloon use
Efficiency of space
Double sided viewing
Side view of balloons b. Advanced aperture framework balloon displays often also take advantage of the basic benefits of anchor frameworks Secure, long hold on balloons
Incorporation of local supplies
More choice in inflation sizing c. Advanced aperture framework balloon displays also take advantage of combinations of new characteristics Added strength and display control with multilayers, multiplanar and non planar forms
More diversity of presentation options with variations in relative angles of apertures, framework and viewers
Easy loading and anchoring of balloons with the innovation of aperture gates.
Adjustable sizing of framework apertures with interlocking strips

BACKGROUND OF THE INVENTION

I. Anchored Framework Displays

A. Introduction

Anchored Framework Balloon Displays incorporate any of at least three different approaches to anchoring balloons to some structural framework.

1. Probably most common is attaching the neck or stem of the balloon directly to a framework.

2. A second approach is to use adhesive/s between the balloon and the structure.

3. A third approach is to use multi part connectors. "Multipart" means something more than a direct connection or in addition to an adhesive between the balloon and framework.

B. Stem Anchors

Most often anchor techniques attach balloons by their stems to structures, frameworks or to each other. These stem anchor techniques may be classified into at least five types by the way the stem is connected to the structure and at least three general classes by the way the balloon is positioned.

1. Types of Stem Anchor Connections a. Balloon Wrap

It is probably most common to wrap or tie the stem of the balloon around some part of the structure or framework b. Structure Wrap It is not unusual to wrap or tie some part of the structure around the stem of the balloon. This regularly occurs when monofilament or ribbon is tied around the neck of a balloon. In one variation, the stem of the balloon is passed through a hole in the structure which is too small for the lips of the balloon to pass back through under the normal stresses of the display.

c. Pinch

In some cases the stem of the balloon will be forced into a slit or other narrow opening in a structure which is so tight as to hold the stem in place under normal stresses of the display.

d. Penetrate

Occasionally, part of the structure will actually penetrate the stem of the balloon (in a section of the stem which is outside the inflated portion of the balloon) to hold the stem in place.

e. Combinations

Many variations and combinations of these types of anchor connections are in general use.

2. Classes of Balloon Positioning a. Class #A Loose Balloon Positioning

In the first class are connections which anchor the balloons loosely to the structure or framework. This first class can be seen in such classic balloon display forms as "string of pearl" arches or garlands. In these balloon displays, balloon stems are usually tied or clipped to a thin line such as monofilament or narrow string. The balloons, when helium filled, float up into an arch with balloons spaced along the line so that the balloons rarely or barely touch a neighboring balloon. In the garland version, balloons are similarly tied but filled with nitrogen or normal breathing air. The balloons then hang in a curve from the line with the balloons rarely or barely touching a neighboring balloon. Even when tied tightly to the line, the flexibility of the line and of the elastic connection leave the balloons to swing freely in the air currents. The same looseness of connection may be seen when balloons are connected to more rigid wires, rods, nets, grids etc. The balloons may still flop about in even gentle air currents. These kinds of connections are made with nylon film balloons as well as with latex balloons.

b. Class #B Tight Balloon Positioning

In the second class of connections, balloons are anchored tightly and directly to some structure or framework so as to fix the position of the balloon in relation to the structure or frame. This can be seen clearly in the old clown feet, in the original use of Rouse Designer Panels and in any of the variety of balloon cups. In each case the balloon is set against the structure and then the balloon stem is stretched to pull and hold the balloon tightly against the structure. The stem is then anchored to the structure so as to maintain the elastic pull of the balloon against the structure. Similar connections are normal with nylon film balloons as well. In the nylon film balloons the material is not so elastic as latex. The pressure of the balloon against the structure is maintained more by the "spongy" resilience of (1) the inflated balloon, (2) the twisted stem of the balloon and (3) the structure itself (corrugated board or thin plastic).

c. Class #C Multiple Contact Positioning

In the third class of connections, balloons are anchored to a structure or frame but their relative position is fixed with the assistance of additional contacts. Within this class there are significant variations in the level of distortion of balloons from the pneumatic pressure of the balloons against adjoining balloons and/or associated framing structures.

1. Minimum Balloon Distortion

Balloon displays in this subclass with minimal balloon distortion are seen on a daily basis in balloon clusters. Stems of inflated balloons are connected to other balloon stems and anchored to some structure or framework. The position of a balloon in such a cluster is determined by a combination of forces applied from different directions. There is the pull between each balloon and the anchor point. There is also the pneumatic pressure of the balloons one against the other. When such clusters of four to eight balloons are displayed independently of other such clusters, there is seldom a noticeable distortion of the balloons.

Another example of the minimal balloon distortion is in the standard loading of Rouse Designer Panels™ in flat sheets and then bending the sheets to create subtle inside curves. Anchor points are spaced at 2" intervals in even rows and columns. Balloons are inflated in diameters of even numbered inches (2", 4", 6", etc.) and anchored to designated points at appropriate distances (2", 4", 6" etc.) apart. the balloons would just barely touch. When the panels are then bent into curved surfaces with the balloons on the inside of the curve the balloons are distorted slightly. The curved structure created is stronger than when flat and the increased contact between balloons covers more of the open space between balloons.

This minimal balloon distortion can also occur with outside curves in the Designer Panels™. This is illustrated in the attached instructions for making a balloon cake (It's A Piece of Cake). The recommended triangular grid placement and 4⅜" sizing of the balloons yields a distortion of about 3⅓%.

2. Obvious Balloon Distortion

Balloon displays in this subclass with more obvious distortion occur when the clusters are forced together into packed columns, arches and garlands. In this form of balloon display, clusters of four to six balloons are forced from their natural, three dimensional arrays into a relatively flat form with balloons radiating from the center like spokes on a wheel, all in the same plane. The balloons are noticeably distorted where they contact adjacent balloons in the cluster. Balloons in such a pattern would spring back to there natural, three dimensional arrays except that another such cluster is stacked on top; then another, and another. These stacks of flat clusters are held together by some structure running through the centers of the clusters. The pressure of balloons in one cluster against the balloons in an adjacent cluster also produces perceptible distortion of the balloons.

This pattern of forcing anchored clusters together is further expanded in "precision wall" construction. Precision balloon walls are made by tying tightly together packed columns of anchored clusters of balloons.

This, more obvious distortion occurs when the inside curves with the Rouse Designer Panels™ is more acute rather than subtle.

It also occurs when the triangular pattern of the cake sides is used with the Designer Panels™ flat rather than curved. This produces balloon distortion of over 8½%.

3. Considerable Balloon Distortion

Balloon displays in this subclass with considerable distortion occur in "balloon topiary" constructions. In balloon topiary sculptures a net, grid, or closely woven framework is constructed like a perforated shell to create a desired three-dimensional form. Openings in this shell are smaller than the natural diameter of the inflated balloons that are anchored to the framework. Balloons are often connected individually to the framework but are frequently connected as clusters of two or more. Some balloons may find their way to the inside of the shell, but the general intent is to keep the balloons on the outside of the framework. Balloons are usually attached to the framework in such quantities as to significantly distort the balloons from pressures of balloons against balloons and balloons against the framework. The idea is to anchor a sufficient number of squeezed balloons to the shell so as to fill all the cracks between balloons and create the illusion of a solid, textured surface on the framework. This produces balloon distortion in excess of 20%.

C. Adhesive Anchors

Current adhesive techniques fall into at least three general categories; chemical, thermal and backed.

1. Category #1 Chemical Adhesives

In the first category are chemical adhesives directly between the balloon and the framework. This includes use of things like rubber cement, stick (rub on) glue, spray adhesive and adhesive transfer tape. In these cases the sticky chemical is the only thing between the balloon and the framework.

This category also includes adhesives that may not activate until contact between two appropriately coated surfaces. Adhesives of this type would have the advantage of reducing inadvertent adhesion of framework or balloon to inappropriate surfaces.

Similarly, this category also includes adhesive which activate only with the application of a separate catalyst.

2. Category #2 Thermal Adhesives

In the second category are thermal adhesives directly between the balloon and the framework. This includes use of things like hot glue, cold glue and pan glue. In these cases the "sticky" is the only thing between the balloon and the framework, but the bonding power of the adhesive comes as the adhesive cools.

3. Category #3 Tapes

In the third category are tapes. This includes use of adhesives with backing material. Two sided tapes are often used. One-sided tape may be circled into a loop with the adhesive on the outside to grab both the balloon and the framework.

D. Multi-Part Anchors

1. Description

Multi-Part anchors are also normal. "Multi-part" refers to additional parts connecting the balloon and the structure other than adhesive or the balloon itself. Here are just three of many possible examples:

2. Examples a. Paper clips are sometimes connected to the lips of balloons and then to a structure.

b. Hook & loop fasteners such as Velcro® are sometimes used to connect balloons to the structure.

c. monofilament (fishing) line is frequently tied to the neck of balloons and then tied to some additional structure.

II. Aperture Framework Displays

In addition to the anchored framework balloon displays discussed above, there are also aperture framework balloon displays.

A. Description

1. The Plane of the Balloons

Aperture framework balloon displays secure and position the balloons in the same plane as the framework. It is normal, however, for the sheet of balloons to be thicker than the framework that holds them.

Normal anchor balloon displays have the balloons generally on the surface of, or surrounding the framework.

2. Balloon Attachment

Currently, aperture frameworks do not count on stem anchors, adhesives, or multi-part anchors to hold the balloons within the framework. They use strictly the pneumatic pressure of the balloons squeezed into the apertures of the framework to secure and position the balloons.

3. Layers of the Display

Currently, aperture frameworks enclose a single, flat layer, sheet, or plane of balloons. The Skistimas Design System™ QuickFrame™ does use a double layer of wire grid, but this mechanism simply yields a wider band of framework to hold a single layer of balloons.

4. The Plane of the Apertures

Currently, the plane of apertures in Aperture Frameworks Balloon Displays is the same as the plane of the overall aperture framework 5. Viewing Angles Currently, Aperture Framework Balloon Displays are designed to be viewed successfully from a relatively wide range of angles centered on a line generally perpendicular to the plane of the framework that is also perpendicular to the plane of the apertures.

B. Background

The aperture approach may not be as old as the anchor techniques, but it has been in public use in the United States since at least 1983. Here are some examples:

1983

E. K. Fernandez shows has been displaying balloons for their dart game at carnivals and fairs by squeezing the balloons into wooden grids since 1983.

1985

Amy Stewart reports squeezing balloons into grids made out of taped together facial tissue boxes as far back as 1985.

1988

Amy Stewart reports using wooden baby gates with balloons squeezed into them to create a display in her new store location starting in July of 1988.

Tim Dilsaver reports squeezing balloons into a grid made of open-ended crates for a trade show display in 1988.

Rick Sicolo reports squeezing balloons into a "chicken wire" grid as part of a store window display in 1988.

Robb Knapp reports squeezing balloons into cut outs in foam board cylinders in the late 1980's.

Graham Rouse taught and published designs with balloons squeezed into his Rouse Designer Panels™ in 1988.

Jim Reese reports squeezing #260 balloon flowers into grids of inflated round balloons in 1988.

1989

Philip Cedillos reports squeezing balloons into 6" wire grid frames for a public decor project in 1989.

1990

David Gully reports squeezing balloons into 6" wire grid frames for customers as early as Jul. 4, 1990.

Kevin LaCount reports squeezing balloons into wooden lattice for decorating jobs starting in 1990.

Bruce Walden reports squeezing balloons into the grid openings in plastic snow fence for a decorating job in Canada in 1990.

1991

Marvin Hardy reports squeezing round balloons into grids made of #260 long balloons for an international kaleidoscope convention in 1991.

1992

George Quintero reports a similar use to that of Kevin LaCount of wooden lattice with balloons squeezed into the openings prior to 1993. These systems produce balloon distortions as high as 42.8%.

1993

Marvin Hardy reports the first public use of his "MagiGrid" in the spring of 1993. This is a metal grid with compartments of adjustable size into which he squeezed balloons for display.

Pat and Jim Skistimas produced a balloon quilt with balloons squeezed into wire fence for a summer balloon convention in 1993.

Carolyn Hadin reports first squeezing balloons into the 3" square grid of standard store fixture wire frames in the fall of 1993.

1994

Pioneer Balloon Company introduced the double wire frame Skistimas Design System™ for displaying balloons squeezed into the 6" square grid openings in the spring of 1994.

1995

Graham Rouse reports the first public use of his expandable Rouse Matrix Systems™ with balloons squeezed into the honeycomb plastic grid openings in the winter of 1995.

Commercial Systems

I have identified only 4 aperture framework systems custom manufactured for balloon decorators in the USA.

Graham Rouse's "Designer Panels" from 1988,

Marvin Hardy's "MagiGrid" from 1993,

James Skistimas's SDS™ from 1994, and

Graham Rouse's RMS™ from 1995

While all are still in use, only the last two are currently being marketed for decorators generally.

All recommend that balloons be under inflated from their normal size to give the balloons the resilience necessary for the physical distortions (13.33% to 57%) involved in squeezing the balloons into place.

DETAILED DESCRIPTIONS

I General Discussion of the Invention

A. Introduction

Figure 1:
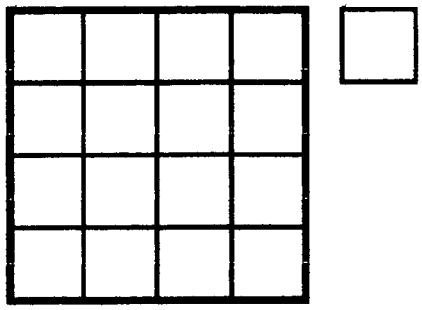
FIG. 1 illustrates a standard aperture framework.

This invention creates Advanced Aperture Frameworks with significant practical and esthetic benefits over previous systems.

1. Anchor Techniques

This invention teaches the use of anchor framework methods and apparatus to hold balloons within the plane of aperture frameworks.

2. Multi-Layers

This invention teaches the use of multiple layer aperture frameworks.

3. Aperture Plane

This invention teaches the use of aperture frameworks in which the plane of apertures is not the same as the plane of the overall framework.

4. Viewing Frameworks

This invention teaches the use of aperture frameworks that are intended to be viewed from angles not generally centered on a line perpendicular to the plane of the overall framework.

5. Viewing Apertures

This invention teaches the use of aperture frameworks that are intended to be viewed from angles not generally centered on a line perpendicular to the plane of the apertures.

6. Multi-Plane Aperture Frames

This invention teaches the use of apertures that are framed in more than one plane, including non parallel planes.

7. Multi-Plane Aperture Frameworks

This invention teaches the use of aperture frameworks that extend in more than one plane, including non parallel planes.

8. Non Flat Aperture Frames

This invention teaches the use of apertures that are framed in non-planar (essentially not flat) ways.

9. Non Flat Aperture Frameworks

This invention teaches the use of aperture frameworks that are non-planar (essentially not flat).

10. Aperture Gates

This invention teaches the use of aperture "gates" in the frame of the aperture.

11. Balloons as Framework Connectors

This invention teaches the use of the balloons in the display as mechanisms to connect aperture frameworks together into larger units.

12. Combinations

This invention teaches use of interlocking strips to produce aperture frameworks with hand adjustable apertures.

13. Combinations

This invention teaches use of combinations of these advanced aperture framework apparatus and methods.

B. Anchored Aperture Frameworks

1. Stem Anchors a. One Anchor Per Balloon

This invention teaches the use of Class B and/or Class C positioning anchors within aperture frameworks so as to secure and position the anchored balloon in the same plane as the framework. Only one such anchor is necessary, though more may often be used productively, in order to effectively keep the balloon essentially in the plane of the aperture framework if a Class B or Class C positioning anchor is used. This eliminates exclusive reliance upon pneumatic pressure to secure and position balloons in aperture frameworks as is the case under current usage in the trade. This makes available to aperture frameworks the efficiencies and esthetic advantages of anchor frameworks. This makes available to anchor methods the efficiencies and esthetic advantages of aperture frameworks.

b. Multiple Anchors Per Balloon

This invention teaches the use of multiple anchors within aperture frameworks so as to secure and position the anchored balloon in the same plane as the framework. This eliminates exclusive reliance upon pneumatic pressure to secure and position balloons in aperture frameworks as is the case under current usage in the trade. This makes available to anchor methods the efficiencies and esthetic advantages of aperture frameworks.

Currently most balloons are nominally "round" and have one stem for use in anchoring. Some of the "entertainer" family of balloons (#130, #260, #340, #350, #360, #315, #318 and specialty balloons for Apples and Bee bodies) have two ends which can be left uninflated or under inflated and used effectively to anchor balloons to each other or to separate frameworks. More recently, a larger version of the "Bee Body" balloons is being produced in Australia. Such multiple anchoring means class one anchors can be used and still retain the position of the balloon in the plane of the framework. Multiple Class B or multiple Class C positioning anchors add additional security for the positioning of the balloons.

This invention anticipates the development of new shapes in both latex and "foil" balloons with two or more tabs, stems, protrusions, or the like, that will facilitate multiple anchoring. There already exist special techniques for adding anchor points to round balloons, but they are more difficult to make and use than would be the case if balloons were already manufactured with additional tabs, stems, or protrusions.

c. Anchor Configurations

This invention teaches the use of all five types of Stem Anchor Connections to hold balloons in the plane of an aperture framework.

2. Adhesive Anchors a. Spot Adhesive

This invention teaches the use of spot adhesive within aperture frameworks so as to secure and position the anchored balloon in the same plane as the framework. Spot adhesives can have the effect of single or multiple stem anchors discussed earlier. Or, one or more adhesive spots within an aperture might serve to supplement a single or multiple stem anchors or area adhesive. Adhesive spots that are placed appropriately can reduce costs over more generally applied adhesives to hold balloons in place.

1. This invention teaches the use of Category #1, #2, and/or #3 adhesive as discussed in II.C. above.
2. This invention teaches application of spot adhesive at the time the framework is manufactured.
3. This invention teaches application of spot adhesive as a post manufacturing operation. Such a post manufacturing operation might be associated with the distribution of the product and/or with the end use of the product.
4. This invention teaches the use of single and/or multiple adhesive spots within an aperture.
5. This invention teaches the use of spot adhesive in conjunction with other anchor techniques as well.

b. Area Adhesive

This invention teaches the use of area adhesive within aperture frameworks so as to secure and position the anchored balloon in the same plane as the framework. "Area" is intended to suggest the more general distribution of adhesive than would be indicated by "spot" without denoting overall surface coverage. Area adhesives can have the effect of single or multiple stem anchors discussed earlier. Or, one or more adhesive areas within an aperture might serve to supplement a single or multiple stem anchors or adhesive spots. Adhesive areas that are placed appropriately can reduce costs over more generally applied adhesives to hold balloons in place. At the same time, by increasing the area of adhesive coverage over spot applications, it would be possible to use less aggressive adhesives that would allow for repositioning or replacing balloons with less risk of breaking the balloons.

1. This invention teaches the use of Category #1, #2, and/or #3 adhesive as discussed in II.C. above.
2. This invention teaches application of area adhesive at the time the framework is manufactured.
3. This invention teaches application of area adhesive as a post manufacturing operation. Such a post manufacturing operation might be associated with the distribution of the product and/or with the end use of the product.
4. This invention teaches the use of single and/or multiple adhesive areas within an aperture.
5. This invention teaches the use of area adhesive in conjunction with other anchor techniques as well.

c. General Adhesive

This invention teaches the use of general adhesive coverage within aperture frameworks so as to secure and position the anchored balloon in the same plane as the framework. General adhesives can have the effect of multiple stem anchors discussed earlier. By increasing adhesive coverage over spot or area applications, it would be possible to use less aggressive adhesives that would allow for repositioning or replacing balloons with less risk of breaking the balloons.

1. This invention teaches the use of category #1, #2, and/or #3 adhesive as discussed in II.C. above.
2. This invention teaches the general application of adhesive at the time the framework is manufactured.
3. This invention teaches the general application of adhesive as a post manufacturing operation. Such a post manufacturing operation might be associated with the distribution of the product and/or with the end use of the product.
4. This invention teaches the use of general adhesive in conjunction with other anchor techniques as well.

d. Balloon Adhesive

This invention teaches the use of adhesive initially applied to the balloon as well as adhesive initially applied to the framework.

1. This invention teaches the use of adhesive initially applied to both balloon and framework before balloon and framework are assembled into a display.
2. This invention teaches the use of category #1, #2, and/or #3 adhesive as discussed in II.C. above.
3. This invention teaches the use of adhesives which activate effectively only upon contact of two appropriately coated surfaces or upon the application of an independent catalyst.
4. This invention teaches the general application of adhesive at the time the framework and/or balloon is manufactured.
5. This invention teaches the application of adhesive as a post manufacturing operation. Such a post manufacturing operation might be associated with the distribution of the balloon/framework and/or with the end use of the balloon display.

e. Post Assembly Adhesive

This invention teaches the use of adhesive after the balloon/s and framework are assembled into a display as well as before or during the display construction process.

1. This invention teaches the insertion of adhesive, catalyst, or the like between the surfaces of the balloon and framework after the balloon is in place inside the framework as well as before or during the balloon placement process.
2. This invention teaches the removal of some protective coating over the adhesive after the balloon is in place inside the framework as well as before or during the balloon placement process.
3. This invention teaches the use of other post installation activation mechanisms. This would include but not be limited to the use of pressure sensitive adhesives that require some time period of contact before any significant bonding takes place.

3. Multi-Part Anchors

This invention teaches the use of other elements in addition to the balloon, the structure and adhesives to fix the position of balloons in the apertures of aperture frameworks.

This invention teaches the use all the anchoring mechanisms previously discussed to connect the balloon to the additional element.

This invention teaches the use all the anchoring mechanisms previously discussed to connect the structure to the additional element.

4. Design Functions & Benefits a. Improve Pneumatic Dependent Systems

This invention teaches the use of anchor methods and apparatus to improve the functionality of current and new configurations of aperture framework balloon displays over their functionality when dependent exclusively on pneumatic pressure to hold balloons in place. This includes, but is not limited to these examples:

1. This invention teaches the use of anchor methods and apparatus to reduce the risk of balloons being prematurely forced out of the apertures in which they are held by increasing the holding power of the framework over pneumatic pressure alone.
2. This invention teaches the use of anchor methods and apparatus to extend the time in which balloons will be held in their apertures even after balloon shrinkage has eliminated the holding power of pneumatic pressure.
3. This invention teaches the use of anchor methods and apparatus to hold balloons to the aperture (rather than falling to the floor) even if the balloon is knocked off center and essentially out of the plane of the aperture.
4. This invention teaches the use of Class A, Class B, and/or Class C anchors on the outer edge of the aperture framework will allow the extension of the balloon display beyond the limits of the framework itself and still remain in the same plane.
5. This invention teaches the use of anchor methods and apparatus to reduce the inflated size of a balloon necessary to be held effectively in a given aperture size.
   - a—This allows the use of smaller and less expensive balloons.
   - b—This allows for greater under inflation of a given nominal size of balloon.
   - c—The greater under inflation would leave the skin of the balloon thicker and stronger to resist the stresses of display construction, transport and installation.
   - d—The greater under inflation would make the balloon softer and easier to install.
   - e—The greater under inflation would generate less stress on the surrounding framework.

b. New Anchor Dependent Systems

This invention teaches the use of anchor methods and apparatus to facilitate the development of new configurations of aperture framework balloon displays that would not be practical without supplement to or replacement of dependence on pneumatic pressure as the single mechanism holding balloons in place.

1. Larger Inflation & Aperture

This invention teaches the use of anchor methods and apparatus to allow enlargement of the recommended inflation size and associated aperture size of a balloon of a given nominal size for use in an aperture framework.

a—Wrap Around Effect

The Rouse Matrix Systems "Builder", for example, has hexagonal apertures with a distance of 8" from point to opposite point and 6.93" from flat side to opposite flat side of any given hexagon. For installation in these openings it is recommended that nominally 11" latex round balloons be inflated to a diameter of 8". The balloon is held in place through a combination of pneumatic pressure, friction, and "wrap around" effect.

Where the straps of the Matrix enclose the balloon as designed, the balloon can expand to only 6.93". Immediately on either side of the straps, however, the balloon can expand until it bumps into another, adjacent balloon. This is approximately 7.2". This produces 6 places on each side of the aperture where the balloon "wraps around" (about 0.125" each) the straps of the aperture. This "wrap around" helps to resist the balloon sliding out of place.

Much of the balloon's ability to wrap around in this way comes from the extra pliability of the balloon generated by the significant (more than 27%) under inflation of the balloon (down 3" from nominal 11" to 8").

With the use of anchor methods and apparatus, it is no longer necessary to depend on the wrap around effect to help hold balloons in place. The balloons may be inflated much closer to their nominal dimensions without loss of a secure hold on their place in the aperture. The wrap around effect will be minimized, but the anchors can do the job.

b—Reserve Air Effect

One reason aperture size for balloons are 13.37% (in Rouse Matrix) to 20% (in SDS™ QuickFrame™) smaller than the recommended inflation size of the balloons is to build up some reserve air in the balloons.

If latex balloons were inflated only to the minimum size necessary to hold the balloons in place by pneumatic pressure when first installed, the balloons would shortly fall out. Air is constantly escaping through the skin of the balloons. The more the balloon is "over inflated" in relation to the size of the aperture, the longer it takes for pneumatic pressure against the framework to be lost.

With the use of anchor methods and apparatus, it is no longer necessary to depend so greatly on reserve air. The anchor can hold the balloons in place without pneumatic pressure.

Aperture sizes may be larger in relation to the inflated size of the balloons that may be nearer their nominal sizes c—Economy of Scale Use of Anchors in aperture frameworks could yield apertures up to 100% larger in area for the same nominal sizes of balloons. This would mean only half as many balloons would be required to create a balloon graphic of a given size. Or, a balloon graphic of a specific pattern of balloons could be made twice as large with a given number of balloons. Either way, you get twice as much for your investment in balloons.

d—Esthetics of Scale

Balloons of any given nominal size are generally designed for use when inflated close to their nominal size. Their qualities of color and translucency are generally optimized at that nominal size.

Use of anchor methods and apparatus in aperture frameworks will facilitate optimization of these esthetic characteristics by allowing a wider range of balloon sizing options, including sizing balloons near their nominal sizes.

2. Reduced Framework

This invention teaches the use of anchor methods and apparatus to allow reduction in the size, strength, and cost of materials used in construction the framework.

a—Wrap Around Effect

The wrap around effect discussed in (2) (a) above depends not only on the relative over inflation of balloons in relation to the size of the apertures, but also on the thickness of the framework between balloons. If the material of the framework is very thin, there is very little for the balloon to wrap around. The balloons more easily come out.

With the use of anchors to hold balloons in place in the plane of the framework, framing materials may be thinner.

This can be an advantage in terms of reducing cost of material, reducing storage space, and reducing visibility of the framework while increasing the flexibility of the structure.

b—Stress Reduction

The constant pneumatic pressure of balloons against an aperture framework places considerably more stress on the framework, as well as the balloons, than most anchor techniques.

By using anchor techniques instead of pneumatic pressure (or, at least, to reduce the level of pneumatic pressure) weaker and normally less expensive materials become feasible for construction of the framework.

C. Multi-Layered Aperture Frameworks

1. They Are New a. Current Multi-Layer Graphics are not Aperture Frameworks

There are multi-layered balloon graphics systems, but they are not aperture frameworks. The most commonly used is a traditional anchored framework. It is called a "precision wall". In this system, balloons are wrapped around a column, usually in clusters of four balloons. A second cluster is wrapped around the column next to the first cluster. Then additional clusters are wrapped and nested against each other on the column until the column is covered. Additional columns are done in the same way. The columns are pressed together to make a solid wall. Often, fishing line is used to tie the columns together. This system effectively creates five staggered layers of balloons. The front three layers are generally visible from one side.

b. Current Aperture Frameworks Are Single Layer Graphics

The Skistimas Design System™ QuickFrame™ does use a double layer of wire grid, but this mechanism simply yields a wider band of framework to hold a single layer of balloons.

c. Overlays Are Not Additional Layers of Aperture Frameworks

Some of the promotional literature of SDS™, for instance, does show additional balloons on top of the aperture framework layer. These additional balloons are not, however, a second layer of aperture enclosed balloons. These additional balloons use the SDS™ framework as a traditional anchor framework. These additional balloons are most often tied to or through the framework and remain essentially outside the apertures.

2. Graphic Functions

Multi-Layered aperture frameworks provide for alignment of balloons from one layer to the next. See FIGS. 6, 7, 8, and 9 for multilayer examples.

1. Apertures of one layer can be aligned so that balloons which fill them can camouflage gaps between balloons in an adjacent layers
2. Apertures of one layer can be aligned so that balloons which fill them fall directly behind those of an adjacent layer. With this arrangement and appropriate lighting of transparent and translucent balloons, decorative blends of colors can be achieved and changed.
3. Aperture sizes, shapes, and arrangements may be varied between layers to create more complex designs.

3. Structural Functions

Multi-Layered aperture frameworks provide for interlocking layers that can greatly increase the strength of the finished structure. See FIGS. 6, 7, 8, and 9 for multilayer examples.

a. Rigid Frameworks

When a single layer aperture framework balloon display is made with a rigid framework, the strength of the display sheet is mainly determined by the framework. Other things being equal, the strength of the display sheet goes up in direct proportion to the thickness of the plane created by the framework.

If a second layer of rigid framework display is placed behind the first without being connected to the first, neither display is made stronger.

If the two parallel frameworks are generally connected in a rigid manner, then, other things being equal, the strength of the sheet goes up in direct proportion to the thickness of the plane created by the joined frameworks.

Other things being equal, the overall strength of the display would be increased proportionally with the rigid joining of additional layers of rigid frameworks.

b. Flexible Frameworks

When a single layer aperture framework balloon display is made with a very flexible framework, the strength of the display sheet is determined by the balloons. Other things being equal, the strength of the sheet goes up in direct proportion to the thickness of the plane created by the contact area between adjacent balloons.

If a second layer of flexible framework display is placed behind the first without being connected to the first, neither display is made stronger.

If the two parallel displays are generally connected in a rigid manner, then, other things being equal, the strength of the sheet does up in direct proportion to the thickness of the plane created by the joined displays.

Other things being equal, the overall strength of the display would be increased proportionally with the rigid joining of additional layers of flexible frameworks displays.

4. Partial Layer Coverage

This invention teaches the use of partial coverage of a given layer of aperture framework by second or additional layers of aperture framework. See FIG. 9 for one example.

a. Structural Functions

Well planned partial layers can add significantly to the strength of the finished aperture framework balloon display without the necessity of full multiple layer coverage.

b. Graphic Functions

Partial additional layers can be effective for creating relief effects in graphic designs as well as full sculptural effects.

5. Aperture Changes

This invention teaches the use of variations in aperture sizes, shapes and configurations within and between layers. See FIG. 11 for one example.

a. Structural Functions

Well planned variations in aperture configurations can add significantly to the strength of the finished aperture framework balloon display without the necessity of full multiple layer coverage.

b. Graphic Functions

Well planned variations in aperture configurations can facilitate and reinforce graphic designs.

A. Aperture Plane Variations

1. Different from Overall

This invention teaches the use of aperture frameworks in which the plane of apertures is not the same as the plane of the overall framework. (See FIGS. 2, 3, 4, 8, 11, and 12 for a few examples.)

2. Multiple Planes

This invention teaches the use of apertures that are framed in more than one plane, including non parallel planes. (See FIGS. 4 and 12 for two examples.)

3. Non Flat Planes

This invention teaches the use of apertures that are framed in non-planar (essentially not flat) ways. See FIG. 12 for one example.

E. Viewing Angle Variations

1. Not Perpendicular to Apertures

This invention teaches the use of aperture frameworks that are intended to be viewed from angles not generally centered on a line perpendicular to the plane of the apertures. (See FIGS. 2, 3, 4, 8, 10, 11 & 12 for a few examples.)

2. Not Perpendicular to Framework

This invention teaches the use of aperture frameworks that are intended to be viewed from angles not generally centered on a line perpendicular to the plane of the overall framework. See FIGS. 10 and 11 for two examples.

F. Aperture Framework Plane Variations

1. Multiple Planes

This invention teaches the use of aperture frameworks that extend in more than one plane, including non parallel planes. See FIGS. 10 and 11.

2. Non Flat Planes

This invention teaches the use of aperture frameworks that are non-planar (essentially not flat). See FIG. 12.

G. Gates in Aperture Frames

This invention teaches the use of aperture "gates" in the frame of the aperture.

1. Gates for Anchoring

This invention teaches the use of mini-apertures within the frames of balloon apertures to facilitate anchoring balloons.

This "anchor aperture" would be used to secure a stem or multipart anchor by providing a small opening through which the stem of multipart might be attached or enclosed.

This invention teaches the use of gates into those anchor apertures to facilitate their use.

These gates might require some "lock" through anchor mechanisms already discussed. These gates might be "self-locking" as discussed in "3." below.

2. Gates for Displaying

This invention teaches the use of gates into balloon apertures to facilitate their use.

These gates might require some "lock" through anchor mechanisms already discussed. These gates might be "self-locking" as discussed in "3." below.

3. Self-Locking Gates

This invention teaches the use of self-locking gates into balloon apertures and into anchor apertures to facilitate their use. See FIGS. 14, 17, and 18 for examples in sheet framework material with some flexibility. Rigid framework material may profit from spring loaded latches to reclose the aperture after the balloon or the anchoring part is inserted through the gate.

H. Balloons as Framework Connectors

This invention teaches the use of the balloons in the display as mechanisms to connect aperture frameworks together into larger units.

This invention teaches the use of the balloon stems wrapped or tied through anchor apertures in overlapping sections of aperture frameworks to connect adjacent aperture frameworks into larger units. See FIG. 16 for one example using an open anchor aperture. Closed anchor apertures as well as gate anchor apertures and other forms of anchor apertures might be utilized as well.

This invention teaches the use of the balloons to connect adjacent aperture frameworks into larger units by having the balloon pass through two overlapping apertures from two adjacent aperture frameworks and thus serve like a hinge pin.

This invention teaches the use of the balloons to connect adjacent aperture frameworks into larger units by having the balloon connect to balloon/s in an adjacent framework/s. See FIG. 6 for one example of balloons connected to balloons in an adjacent framework. In this case the arrangement creates a multilayered aperture framework.

I. Adjustable Aperture Frameworks

This invention teaches methods and apparatus for the construction and use of interlocking tabs.

This invention teaches the use of interlocking tabs to connect and disconnect aperture frameworks without tools.

This invention teaches methods and apparatus for the construction and use of interlocking straps.

This invention teaches the use of interlocking straps to create aperture frameworks that may be unlocked and reassembled in new configurations without tools.

This invention teaches methods and apparatus for the construction and use of interlocking strap & tab combinations.

This invention teaches the use of interlocking strap & tab combinations to a. add supplementary apertures to frameworks, b. connect and disconnect aperture frameworks without tools, c. create aperture frameworks that may be unlocked and reassembled in new configurations without tools.

J. Combination Aperture Frameworks

This invention teaches the combining of methods and apparatus discussed above to maximize the positive benefits of aperture framework balloon displays.

BRIEF DESCRIPTION OF THE DRAWINGS

FIG. 1 illustrates a standard aperture framework.

Figure 2:
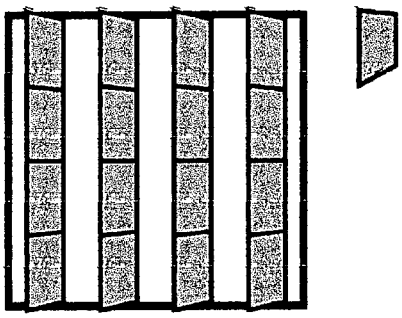
FIG. 2 illustrates an advanced aperture framework with the planes of apertures perpendicular to the plane of the overall framework and apertures stacked in vertical lines.

FIG. 2 illustrates an advanced aperture framework with the planes of apertures perpendicular to the plane of the overall framework and apertures stacked in vertical lines.

Figure 3:
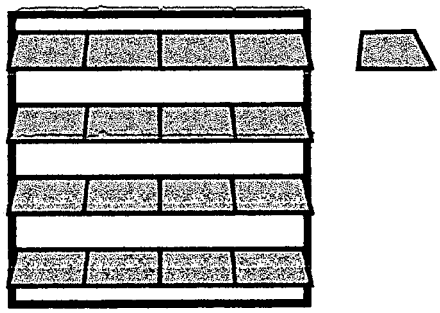
FIG. 3 illustrates an advanced aperture framework with the planes of apertures perpendicular to the plane of the overall framework and apertures arranged in horizontal rows.

FIG. 3 illustrates an advanced aperture framework with the planes of apertures perpendicular to the plane of the overall framework and apertures arranged in horizontal rows.

Figure 4:
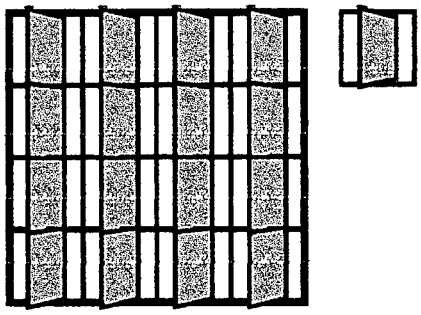
FIG. 4 illustrates an advanced aperture framework with apertures circumscribed in two planes each. One aperture plane is the same as standard aperture frameworks and one aperture plane is the same as in FIG. 2.

FIG. 4 illustrates an advanced aperture framework with apertures circumscribed in two planes each. One aperture plane is the same as standard aperture frameworks and one aperture plane is the same as in FIG. 2.

Figure 5:
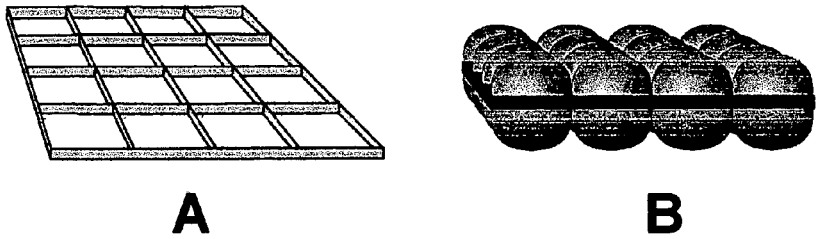
FIG. 5 shows a perspective view of a standard aperture framework both by itself and filled with balloons.

FIG. 5 shows a perspective view of a standard aperture framework both by itself and filled with balloons.

Figure 6:
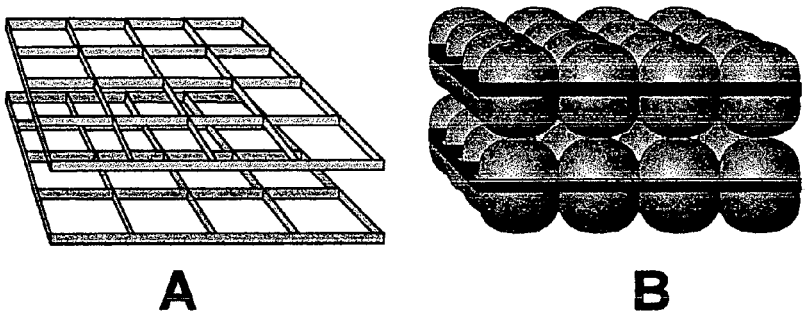
FIG. 6 shows a perspective view of a multilayered, advanced aperture framework balloon display in which the balloons from one layer are connected to the balloons of the second layer but the framework in one layer is not otherwise connected to the framework of the second layer. It also so shows a perspective view of the two frameworks without the balloons.

FIG. 6 shows a perspective view of a multilayered, advanced aperture framework balloon display in which the balloons from one layer are connected to the balloons of the second layer but the framework in one layer is not otherwise connected to the framework of the second layer. It also so shows a perspective view of the two frameworks without the balloons.

Figure 7:
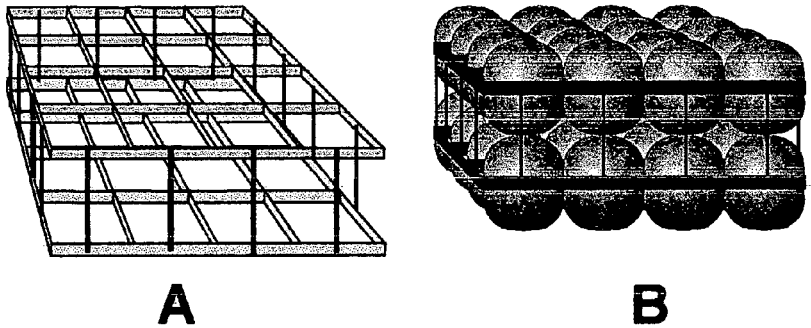
FIG. 7 shows a perspective view of an advanced aperture framework balloon display with two layers of balloons and the aperture framing of one layer of balloons directly connected to the aperture farming of the second layer of balloons. The figure also so shows a perspective view of the framework without the balloons.

FIG. 7 shows a perspective view of an advanced aperture framework balloon display with two layers of balloons and the aperture framing of one layer of balloons directly connected to the aperture farming of the second layer of balloons. The figure also so shows a perspective view of the framework without the balloons.

Figure 8:
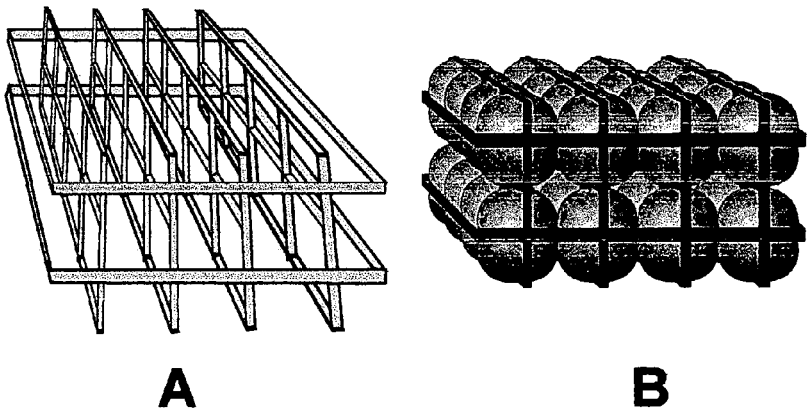
FIG. 8 shows a perspective view of an advanced aperture framework balloon display with two layers of balloons. In this case the aperture framing is perpendicular to the plane of the overall framework and connects the two layers of balloons. The figure also shows a perspective view of the framework without the balloons.

FIG. 8 shows a perspective view of an advanced aperture framework balloon display with two layers of balloons. In this case the aperture framing is perpendicular to the plane of the overall framework and connects the two layers of balloons. The figure also shows a perspective view of the framework without the balloons.

Figure 9:
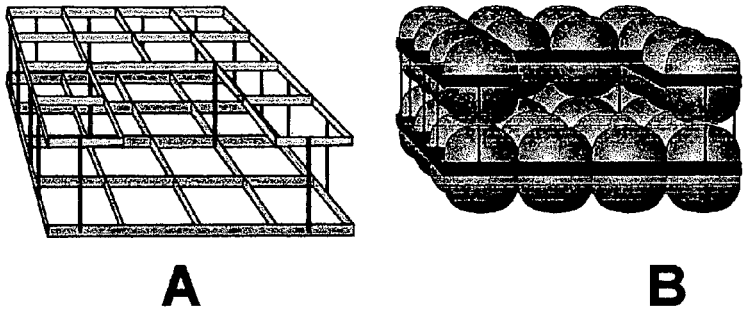
FIG. 9 shows a perspective view of an advanced aperture framework balloon display with two layers of balloons and the aperture framing of one layer of balloons directly connected to the aperture framing of the second layer of balloons. In this case the number and arrangement of balloon and associated circumscribing framework in one layer is different from that in the second layer. The figure also so shows a perspective view of the framework without the balloons.

FIG. 9 shows a perspective view of an advanced aperture framework balloon display with two layers of balloons and the aperture framing of one layer of balloons directly connected to the aperture framing of the second layer of balloons. In this case the number and arrangement of balloon and associated circumscribing framework in one layer is different from that in the second layer. The figure also so shows a perspective view of the framework without the balloons.

Figure 10:
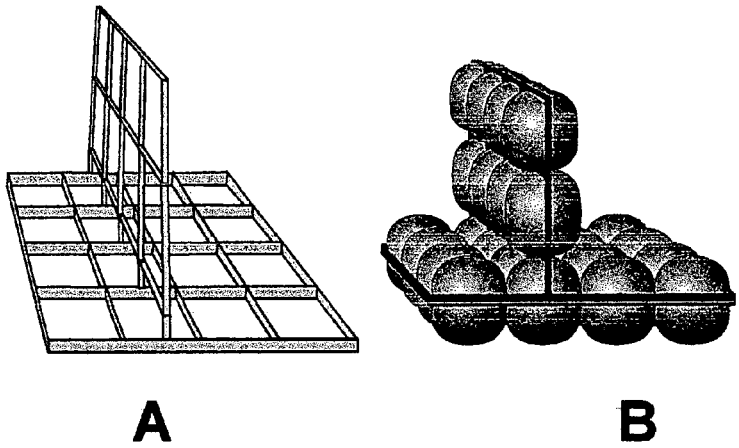
FIG. 10 shows a perspective view of an advanced aperture framework balloon display in which the framework extends in two perpendicular planes. The figure also so shows a perspective view of the framework without the balloons.

FIG. 10 shows a perspective view of an advanced aperture framework balloon display in which the framework extends in two perpendicular planes. The figure also so shows a perspective view of the framework without the balloons.

Figure 11:
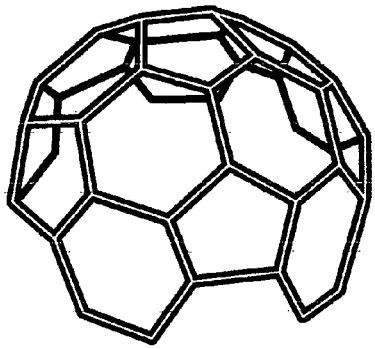
FIG. 11 shows a perspective view of an advanced aperture framework in which the framework is not flat, but rather suggests a double curved surface. Apertures are not the same size or shape or in the same or parallel planes. Viewing is not generally oriented around a single line perpendicular to the plane of the overall framework or the plane of the apertures.

FIG. 11 shows a perspective view of an advanced aperture framework in which the framework is not flat, but rather suggests a double curved surface. Apertures are not the same size or shape or in the same or parallel planes. Viewing is not generally oriented around a single line perpendicular to the plane of the overall framework or the plane of the apertures.

Figure 12:
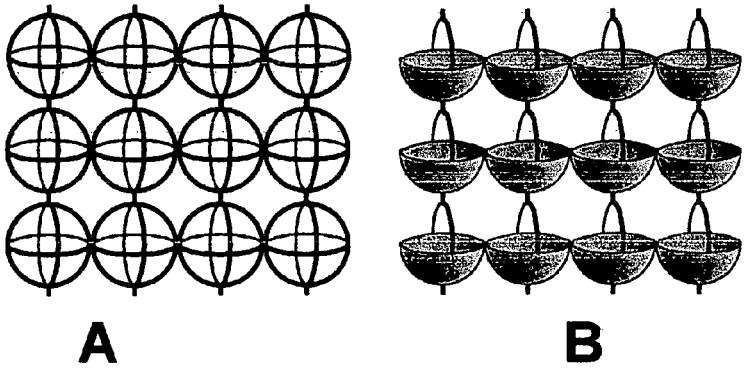
FIG. 12 shows a perspective view of two advanced aperture frameworks with apertures framed on all three axes. It shows some apertures framed with double curved surfaces.

FIG. 12 shows a perspective view of two advanced aperture frameworks with apertures framed on all three axes. It shows some apertures framed with double curved surfaces.

Figure 13:
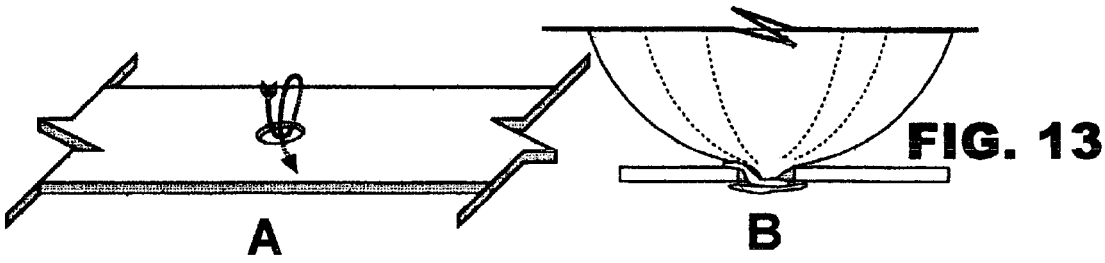
FIG. 13 illustrates a closed anchor aperture. An anchor aperture is a small aperture in the framework circumscribing an inflatable chamber used to facilitate anchoring the inflatable chamber within the aperture.

FIG. 13 illustrates a closed anchor aperture. An anchor aperture is a small aperture in the framework circumscribing an inflatable chamber used to facilitate anchoring the inflatable chamber within the aperture.

Figure 14:
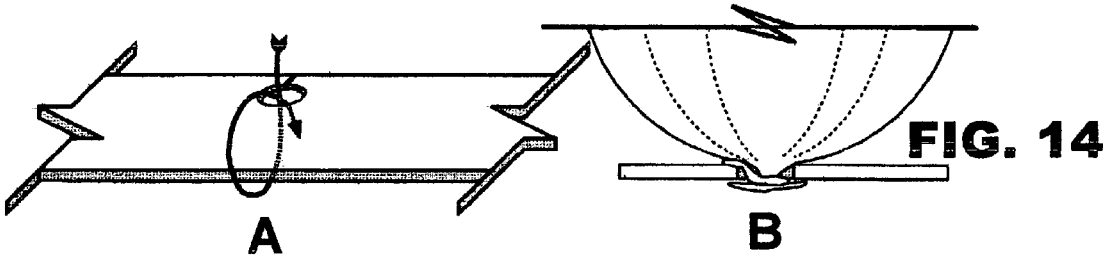
FIG. 14 illustrates an anchor aperture with a simple self-closing gate.

FIG. 14 illustrates an anchor aperture with a simple self-closing gate.

Figure 15:
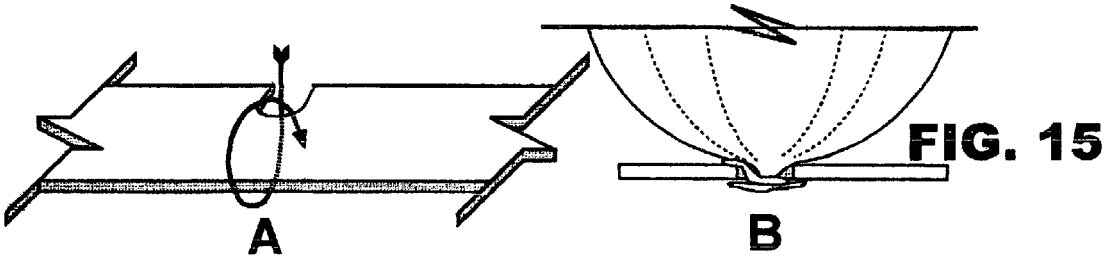
FIG. 15 illustrates an open anchor aperture.

FIG. 15 illustrates an open anchor aperture.

Figure 16:
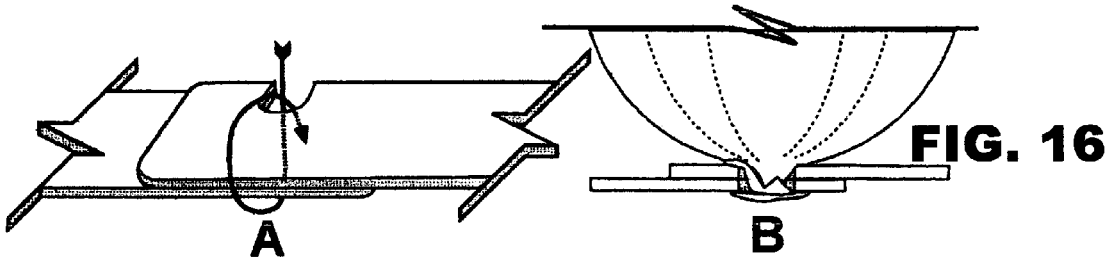
FIG. 16 illustrates the stem of a balloon being used to both anchor the balloon and connect two frameworks.

FIG. 16 illustrates the stem of a balloon being used to both anchor the balloon and connect two frameworks.

Figure 17:
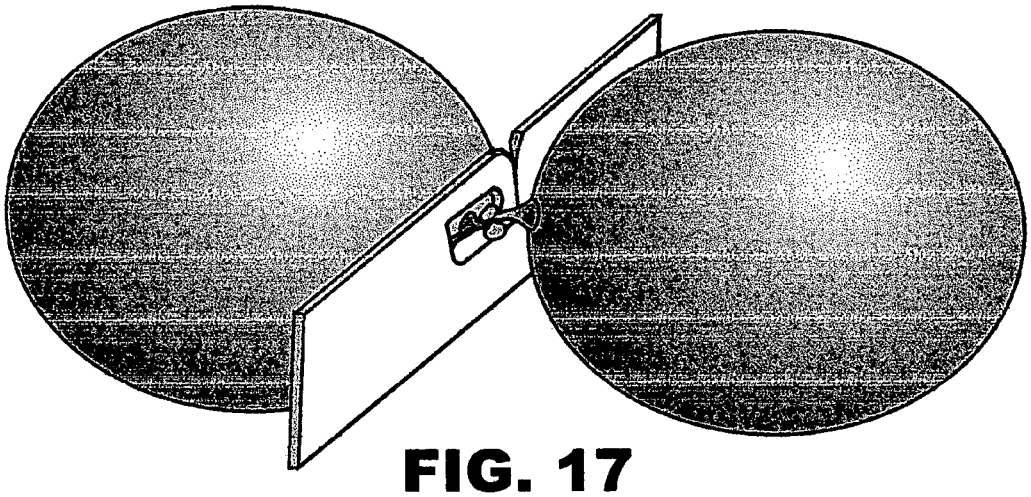
FIG. 17 illustrates the use of a self-locking spiral gate anchor aperture.

FIG. 17 illustrates the use of a self-locking spiral gate anchor aperture.

Figure 18:
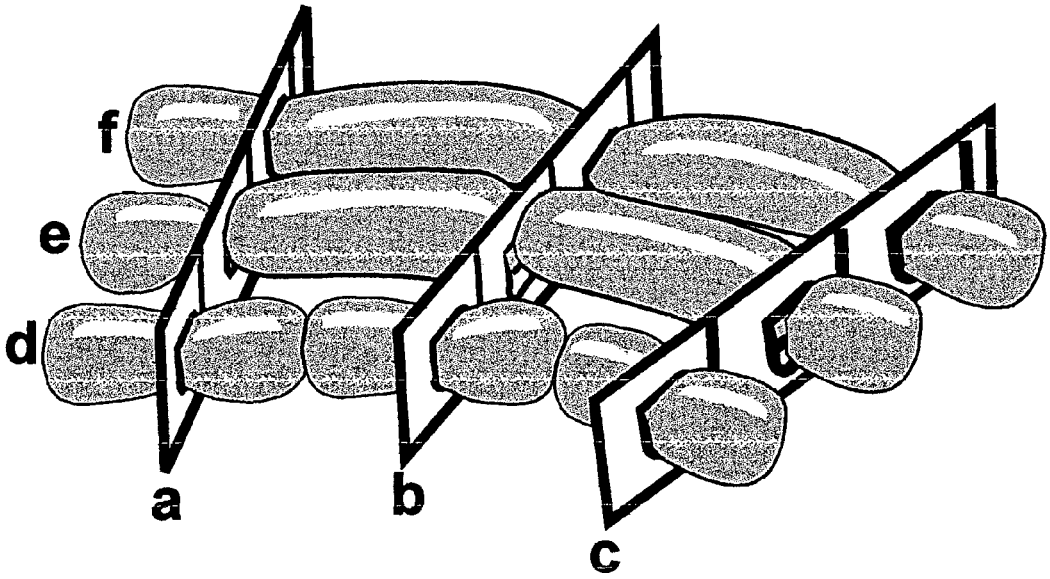
FIG. 18 illustrates the use of self-locking spirals as apertures for inflatable chambers rather than just anchors.

FIG. 18 illustrates the use of self-locking spirals as apertures for inflatable chambers rather than just anchors.

Figure 19:
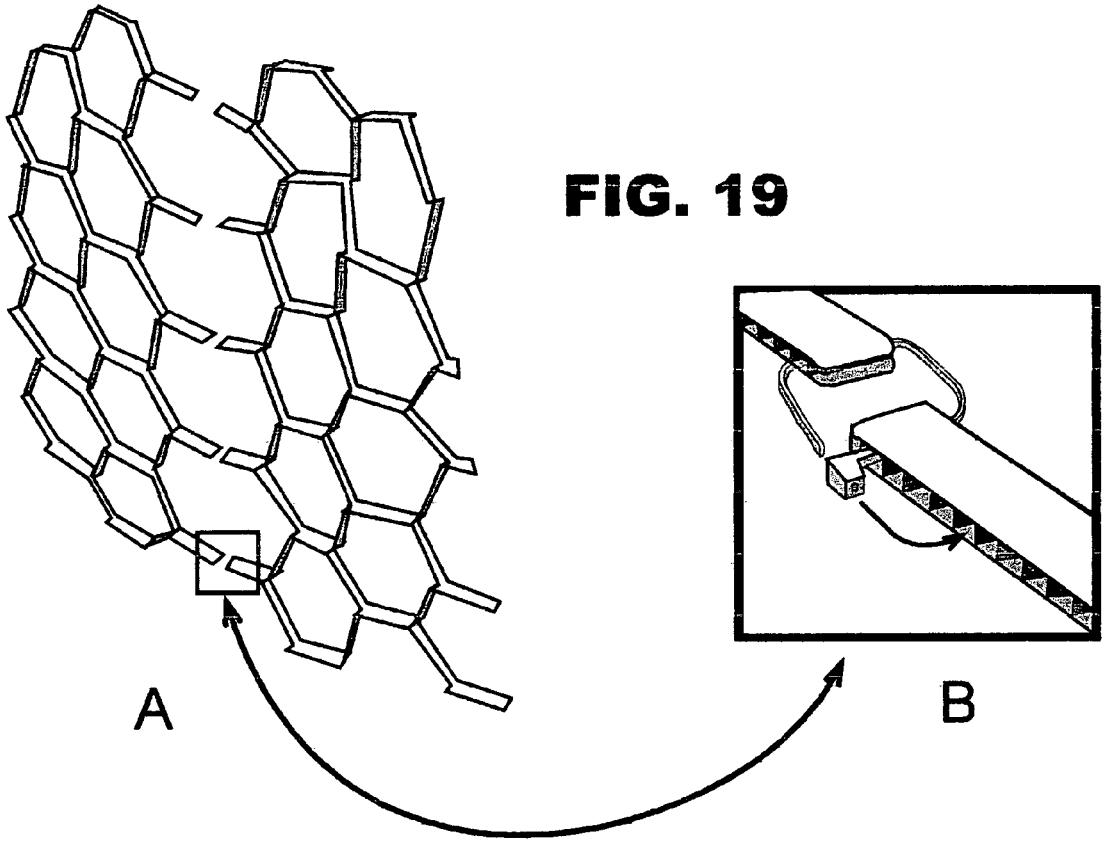
FIG. 19 illustrates the standard alignment of end tabs for connecting two Rouse Matrix Systems™ frameworks and shows how they are normally connected with a cable tie.

FIG. 19 illustrates the standard alignment of end tabs for connecting two Rouse Matrix Systems™ frameworks and shows how they are normally connected with a cable tie.

Figure 20:
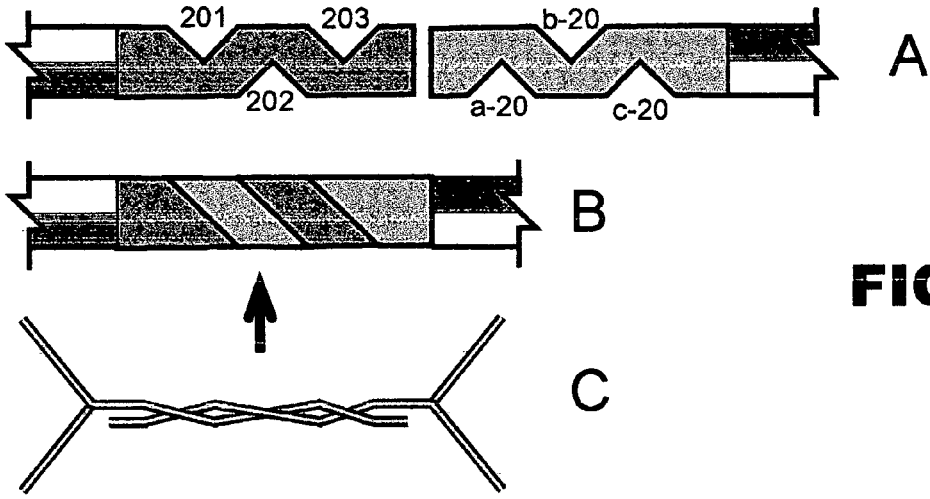
FIG. 20 shows a simple form of connecting end tabs by wrapping them around each other and interlocking especially configured notches.

FIG. 20 shows a simple form of connecting end tabs by wrapping them around each other and interlocking especially configured notches.

Figure 21:
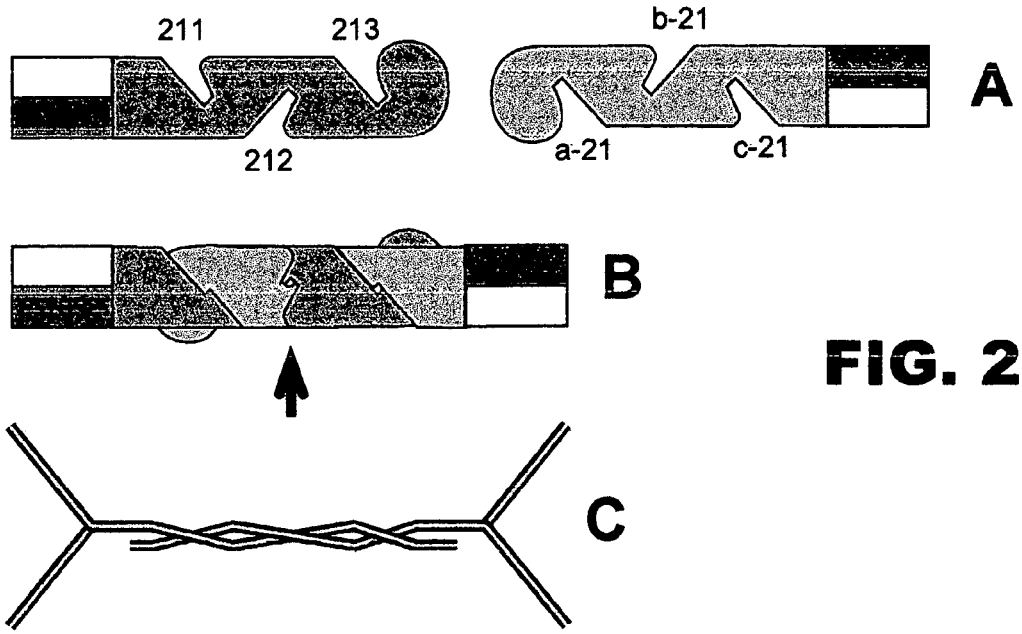
FIG. 21 illustrates the same wrapping or "spiraling" technique as FIG. 20. But with a more sophisticated notch pattern designed to more securely lock the tabs together.

FIG. 21 illustrates the same wrapping or "spiraling" technique as FIG. 20. But with a more sophisticated notch pattern designed to more securely lock the tabs together.

Figure 22:
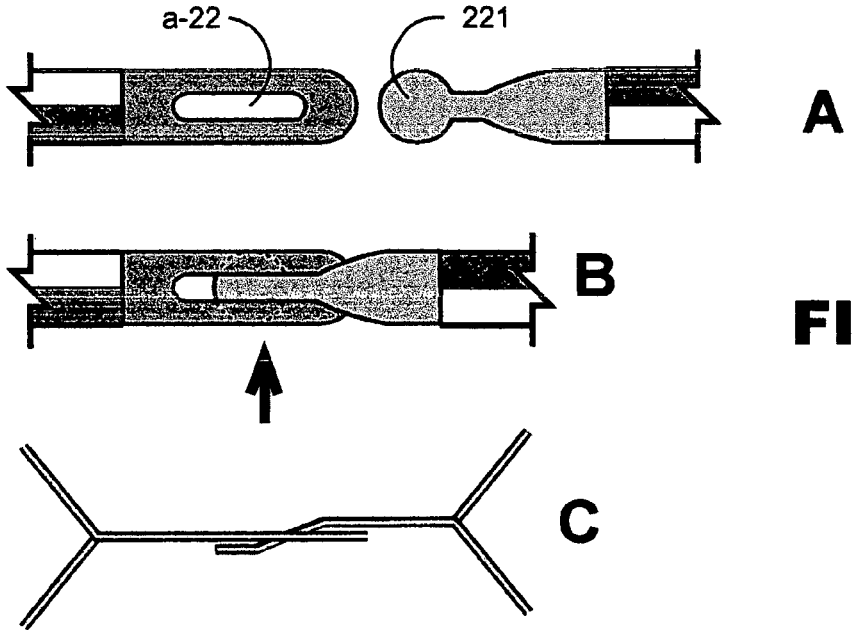
FIG. 22 shows end tabs designed to use a "button hole" type joint to connect the two pieces.

FIG. 22 shows end tabs designed to use a "button hole" type joint to connect the two pieces.

Figure 23:
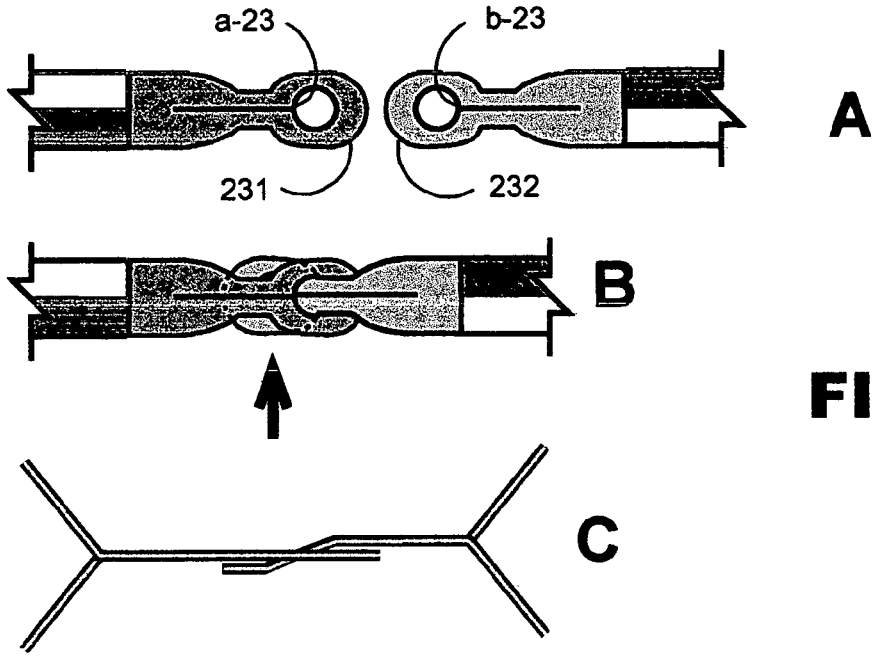
FIG. 23 shows another, more sophisticated, version of a "button hole" joint in which the two tabs are identical.

FIG. 23 shows another, more sophisticated, version of a "button hole" joint in which the two tabs are identical.

Figure 24:
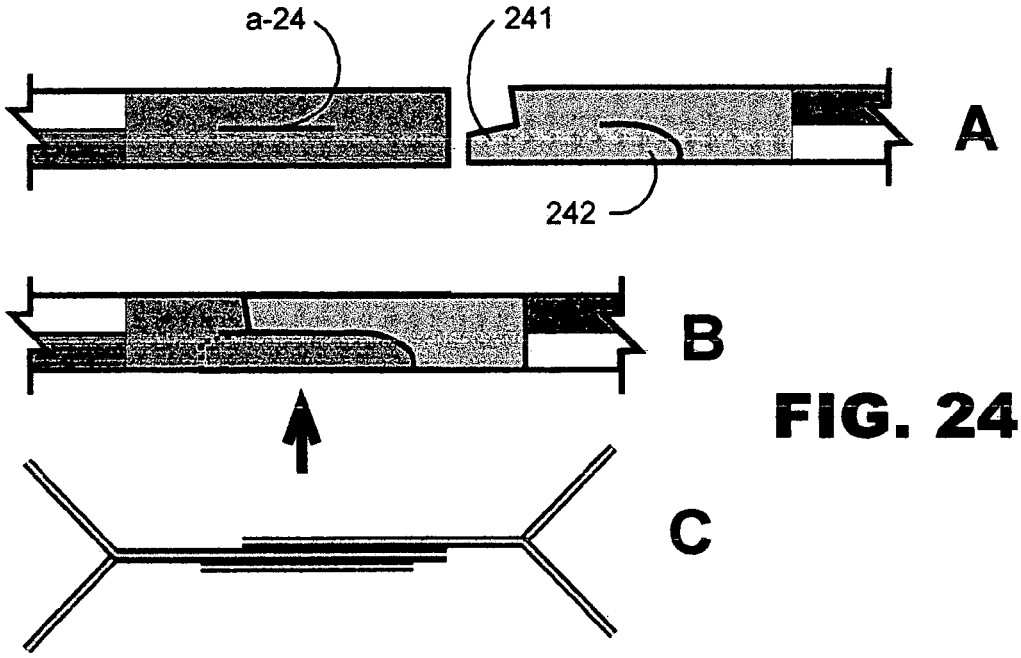
FIG. 24 shows a "fish hook" type joint for connecting the end tabs.

FIG. 24 shows a "fish hook" type joint for connecting the end tabs.

Figure 25:
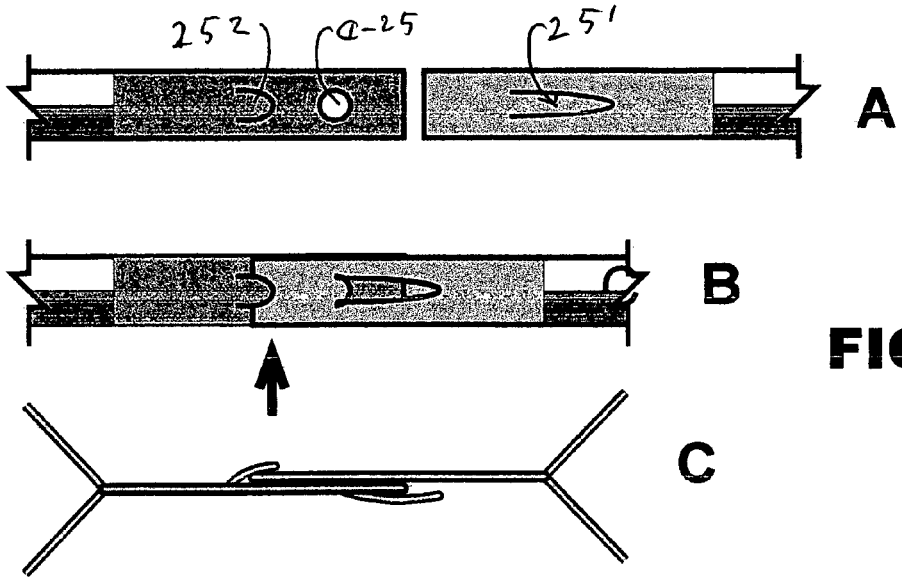
FIG. 25 shows a "tongue hook" type joint supplemented with a cap lock tab to help secure the hold.

FIG. 25 shows a "tongue hook" type joint supplemented with a cap lock tab to help secure the hold.

Figure 26:
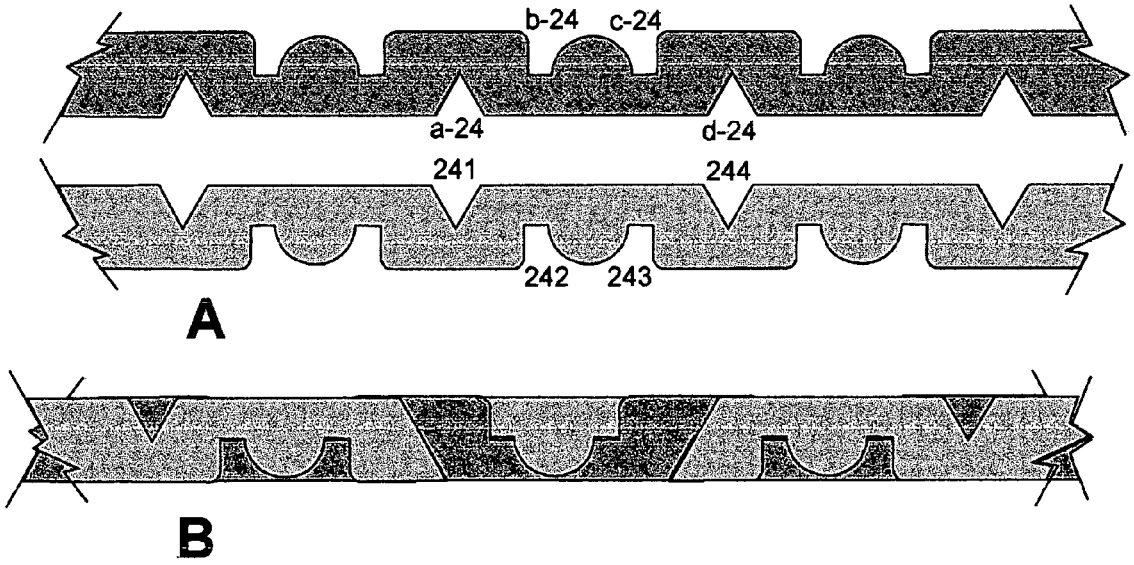
FIG. 26 shows one version of strapping material and how such straps may be wrapped to interlock for the construction of adjustable aperture frameworks.

FIG. 26 shows one version of strapping material and how such straps may be wrapped to interlock for the construction of adjustable aperture frameworks.

Figure 27:
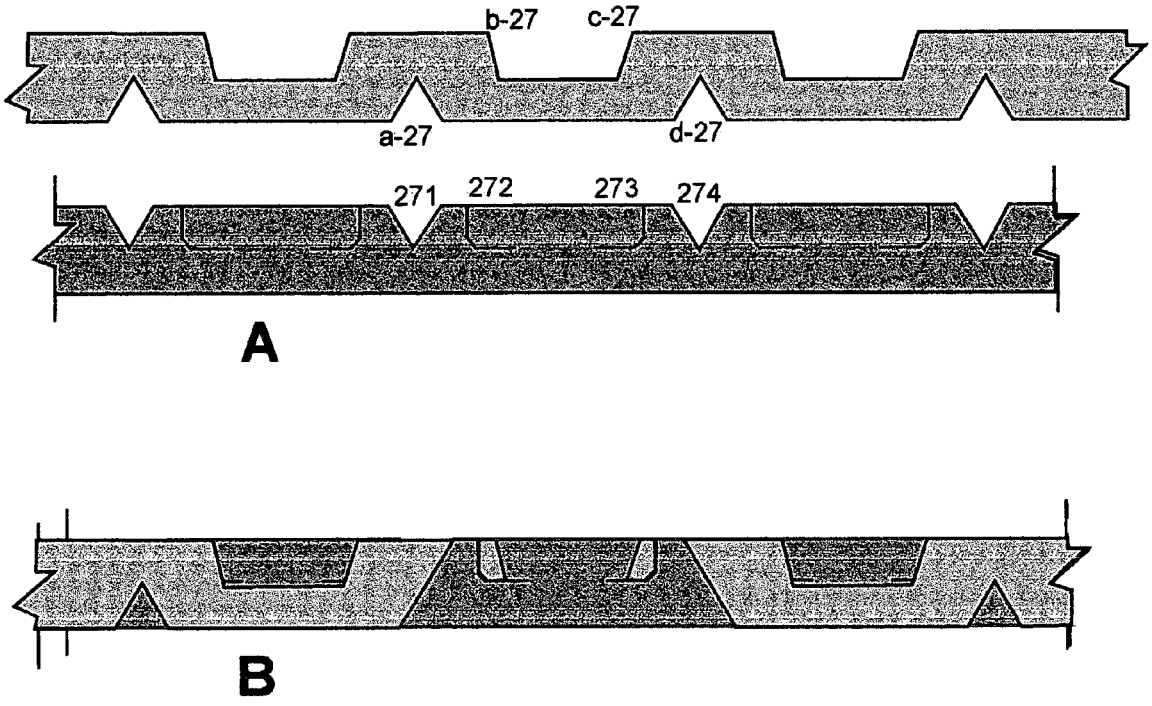
FIG. 27 shows another version of straps with wing tabs used to interlock for the construction of adjustable aperture frameworks.

FIG. 27 shows another version of straps with wing tabs used to interlock for the construction of adjustable aperture frameworks.

FIG. 28 shows one pattern of assembly of special straps for the construction of adjustable aperture frameworks.

II DETAILED DESCRIPTION OF PREFERRED EMBODIMENTS

Referring now to FIG. 1, this shows what would normally be considered a standard aperture framework when filled with inflatable chambers which are at least partially inflated within the white squares representing the apertures, and the inflatable chambers are surrounded by the framework represented by the black lines. This would be true if the inflatable chambers were held in the apertures exclusively by the pneumatic pressure of the inflatable chambers expanding outward against the circumscribing framework as is the common practice in the trade.

The invention here teaches the use of other mechanisms instead of and in addition to pneumatic pressure to hold the inflatable chambers in place in the apertures. When these mechanisms are used instead of or in addition to pneumatic pressure to hold the inflatable chambers in the apertures then this framework would be considered an advanced aperture framework and the display thus created would be considered an advanced aperture framework balloon display. These mechanism include:

(1) at least one neck, stem, tab, or protrusion of an inflatable chamber is wrapped, tied, entangled, or otherwise secured directly to the framework;

(2) at least one neck, stem, tab, or protrusion of an inflatable chamber is secured indirectly to the framework;

(3) at least one area of adhesive is in contact with both the framework and the inflatable chamber;

(4) at least one area of adhesive is in contact with both the inflatable chamber and a backing material for the adhesive, and at least one area of adhesive on the backing material is in contact with the framework;

(5) at least one area of adhesive is in contact with both the inflatable chamber and a backing material for the adhesive, and the backing material is wrapped, tied, entangled, or otherwise secured directly to the framework;

(6) at least one area of adhesive is in contact with both the inflatable chamber and a backing material for the adhesive, and the backing material is connected indirectly to the framework;

(7) at least one set of material connects at least two inflatable chambers which are contained in different apertures, and this connecting material is restricted in it's position by passing through at least one small aperture in the framework between the larger apertures which contain the inflatable chambers;

(8) at least one set of material connects at least two inflatable chambers which are contained in different apertures, and this connecting material is restricted in it's position by passing through at least one small aperture in the framework between the larger apertures which contain the inflatable chambers, and the material surrounding said at least one small aperture has a break, gap, opening, gate, overlap or other access from the outside of said at least one small aperture to the inside of said at least one small aperture without threading one end of said connecting material directly through said at least one small aperture;

(9) at least one set of material connects at least two inflatable chambers which are contained in different apertures, and this connecting material is restricted in it's position by passing through at least one small aperture in the framework between the larger apertures which contain the inflatable chambers, and the material surrounding said at least one small aperture has a break, gap, opening, gate, overlap or other access from the outside of said at least one small aperture to the inside of said at least one small aperture without threading one end of said connecting material directly through said at least one small aperture, and said break, gap, opening, gate, overlap or other access from the outside of said at least one small aperture automatically closes upon insertion of said connecting material sufficiently to maintain the restricted position of said connecting material under the stresses of normal use of the balloon display;

(10) said at least one inflatable chamber each is/are framed in multiple planes;

(11) at least one area of framework circumscribing said at least one inflatable chamber each is textured to increase friction with said at least one inflatable chamber each;

(12) at least one area of said at least one inflatable chamber each is textured to increase friction with said at least one framework;

(13) at least one area of framework circumscribing said at least one inflatable chamber each has ribs, bumps, protrusions, indentations, holes or other significant deviations from a generally even surface to increase the grip on said at least one inflatable chamber each;

(14) at least one area of said at least one inflatable chamber each has ribs, bumps, protrusions, indentations, holes or other significant deviations from a generally even surface to increase the grip on the framework circumscribing said at least one inflatable chamber each;

(15) said at least one framework has custom formed sections to match the form of said at least one inflatable chamber each;

(16) said at least one inflatable chamber each is/are custom formed to match the shape of the framework circumscribing said at least one inflatable chamber each;

(17) at least one area of framework circumscribing an inflatable chamber is made of elastic material which tightens the fit of the circumscribing framework upon the inflatable chamber;

(18) at least one area of the framework an inflatable chamber incorporates at least one spring or other flexible device which presses directly or indirectly against the inflatable chamber;

(19) at least one area of framework circumscribing an inflatable chamber each is made of resilient, compressible material which tightens the fit of the framework against the inflatable chamber.

(20) at least one area between an inflatable chamber each and the framework circumscribing the inflatable chamber is occupied by material which increases the hold between the inflatable chamber and the surrounding framework, at least in part, by at least one mechanism selected from the following list:

a. surface texture that increases friction;

b. adhesive coating;

c. a form that matches to the form of adjacent materials;

d. volume that increases pressure on adjacent materials;

e. resilient, compressible character of material;

f. material of a nature to increase static electric cling.

The reference in this discussion to "inflatable chambers" is used as a more general and more broadly accurate term than "balloons" in relation to aperture framework balloon displays. There are currently on the market multi chambered balloons and this inventor has a patent pending for additional multi chambered balloons. It is anticipated that both current and proposed multi chambered balloons might be productively used in aperture frameworks. In such a case it might become quite common to have only one inflatable chamber of a multi chambered balloon in a single aperture of an aperture framework. Thus an aperture containing "at least one inflatable chamber" would be more generally applicable than an aperture containing "at least one balloon".

The small square in FIG. 1 which is beside the larger square (that is subdivided into sixteen small squares) is to illustrate what constitutes a single aperture in the grid of the larger square. It is for reference to compare to similar side illustrations of single apertures is FIGS. 2, 3, and 4.

While this and other figures in this application illustrate advanced aperture frameworks as thin structures in relation to the size of apertures and inflatable chambers they contain, this need not be the case in reality. The frameworks may be quite large, quite small or in between in the size, in any of its three dimensions, compared to apertures and in comparison to inflatable chambers incorporated in the display. The size of spaces between apertures or between inflatable chambers may be quite large, quite small or in between. Frameworks may be rigid, flexible or in between. The shape of apertures may be quite regular or irregular, large or small. While metal, plastics, and wood are more popular choices for construction of aperture frameworks; paper, cloth or other materials could also be quite satisfactory for advanced aperture frameworks.

Referring now to FIG. 2, this illustrates an advanced aperture framework with the planes of apertures perpendicular to the plane of the overall framework and with apertures stacked in vertical lines. The small trapezoid to the right of the larger square illustrates a perspective view of a single aperture from the advanced aperture framework. This invention teaches the use circumscribing frameworks for individual apertures which are in planes different from the overall framework of the display.

Referring now to FIG. 3, this illustrates an advanced aperture framework with the planes of apertures perpendicular to the plane of the overall framework and with apertures arranged in horizontal lines. The small trapezoid to the right of the larger square illustrates a perspective view of a single aperture from the advanced aperture framework. This invention teaches the use circumscribing frameworks for individual apertures which are in planes different from the overall framework of the display.

Referring now to FIG. 4, this illustrates an advanced aperture framework with the planes of apertures both perpendicular to and the same as the plane of the overall framework. The small trapezoids to the right of the larger square illustrates a perspective view of a single aperture from the advanced aperture framework. Note that the aperture is framed in two planes. This invention teaches the use circumscribing frameworks for individual apertures which are in multiple planes.

Referring now to FIG. 5, this gives a perspective view of an aperture framework similar to the one illustrated in FIG. 1. The framework is shown both without (FIG. 5-A) and with (FIG. 5-B) the apertures loaded with inflatable chambers.

Please note that while this and most other figures in this application illustrate inflatable chambers as roughly spherical objects, this need not be the case in reality. Inflatable chambers need have no particular size, shape, form, texture or material in order to qualify as appropriate for inclusion in an advanced aperture framework balloon display.

Referring now to FIG. 6, this gives a perspective view of two parallel aperture frameworks similar to the one illustrated in FIG. 1 and FIG. 5. The frameworks are shown both without (FIG. 6-A) and with (FIG. 6-B) the apertures loaded with inflatable chambers. When inflatable chambers from one framework are connected to inflatable chambers from the other framework they qualify as an advanced aperture framework balloon display under this invention.

Referring now to FIG. 7, this gives a perspective view of a double layer advanced aperture framework. The framework is shown both without (FIG. 7-A) and with (FIG. 7-B) the apertures loaded with inflatable chambers. When inflatable chambers are arranged in multiple layers within one or more connected frameworks they qualify as advanced aperture framework balloon displays under this invention.

Referring now to FIG. 8, this gives a perspective view of a double layer advanced aperture framework. In this case, the planes of the individual aperture frameworks are perpendicular to the horizontal plane of the overall framework. The framework is shown both without (FIG. 8-A) and with (FIG. 8-B) the apertures loaded with inflatable chambers. When inflatable chambers are arranged in multiple layers within one or more connected frameworks they qualify as an advanced aperture framework balloon display under this invention. When the aperture planes are different from the plane of the overall framework they qualify as an advanced aperture framework under this invention.

Referring now to FIG. 9, this gives a perspective view of a double layer advanced aperture framework. The framework is shown both without (FIG. 9-A) and with (FIG. 9-B) the apertures loaded with inflatable chambers. When inflatable chambers are arranged in multiple layers within one or more connected frameworks they qualify as advanced apertures framework balloon displays under this invention. In this case, the display has the added characteristic that one layer (the upper layer) has fewer inflatable chambers than the other (lower layer). This is not only acceptable to advanced aperture framework balloon displays, but is an advantage taught by this invention for both esthetic and structural purposes. When the larger layer is used as a background, the second (front) layer of the display can be used for raised text and graphics effects. On other occasions the double layer can be used to thicken and thus strengthen the single layer sheet of inflatable chambers.

Referring now to FIG. 10, this gives a perspective view of an aperture framework which extends in two planes. The framework is shown both without (FIG. 10-A) and with (FIG. 10-B) the apertures loaded with inflatable chambers.

Referring now to FIG. 11, this gives a perspective view of a double curved surface advanced aperture framework. The framework is shown without the apertures loaded with inflatable chambers. While it is somewhat unusual for current aperture frameworks to extend in more than one plane or to curve in one direction it is not unheard of. Aperture frameworks as articles of manufacture with double curved surfaces is an innovation of this invention.

Referring now to FIG. 12, this gives a perspective view of advanced aperture frameworks with apertures framed in multiple planes with curved lines (FIG. 12-A) and with double curved surfaces (FIG. 12-B). Frameworks for individual apertures which are multi planar and frameworks for individual apertures with double curved surfaces are innovations of this invention.

Referring now to FIG. 13, this illustrates a closed anchor aperture in both a perspective view (FIG. 13-A) and a cross section view (FIG. 13-B). An anchor aperture is a small aperture in the framework circumscribing an inflatable chamber used to facilitate anchoring the inflatable chamber within the aperture. The arrow shows the path that might be taken by the neck of a balloon through the anchor aperture and around the adjacent section of the framework and then back through the anchor aperture in order to secure the inflatable chamber to the framework.

In this example the neck of a single balloon is used. The lips of the balloon are of a size small enough to be forced through the anchor aperture but large enough not to pull back through under the normal stresses of an advanced aperture framework balloon display. This arrangement supports the position of the balloon within its aperture.

In other examples the neck of one balloon might be passed through the anchor aperture and tied closely and tightly to another inflatable chamber on the other side of the anchor aperture, thereby securing both to the framework in a way that would help both remain in their respective apertures.

It is anticipated that more inflatable chambers with multiple appendages (such as the "bee body" balloon and the Link-O-Loon™) will be developed and marketed. This will facilitate the use of multiple aperture anchors with inflatable chambers and further secure the position of inflatable chambers within advanced aperture frameworks.

Referring now to FIG. 14, this illustrates an anchor aperture with a simple gate (a slit from the anchor aperture proper to the edge of the framework) in both a perspective view (FIG. 14-A) and a cross section view (FIG. 14-B). Such a gate can facilitate inserting the neck of a balloon, or other material connected to a single inflatable chamber or connected to separate inflatable chambers on opposite sides of the anchor aperture. This can be especially useful when inflatable chambers are already connected to each other from the time of their manufacture or from the time of advance preparation for an event.

Referring now to FIG. 15, this illustrates an open anchor aperture in both a perspective view (FIG. 15-A) and a cross section view (FIG. 15-B). This notch is designed, like the original (FIG. 13) anchor aperture to be the right size to allow the insertion of the balloon neck and lips but substantially resist the lips of the balloon from pulling back through in normal use.

Referring now to FIG. 16, this illustrates an open anchor aperture in both a perspective view (FIG. 16-A) and a cross section view (FIG. 16-B). In this case, two different sections of aperture frameworks are overlapped with the open anchor aperture of each aligned with the other. This allows the neck of the balloon to wrap around both and connect the two sections of framework by hand without the use of special tools or accessories.

Referring now to FIG. 17, this perspective view illustrates an anchor aperture with a somewhat sophisticated gate. The slit from the aperture to the edge of the framework spirals to reach its ends. This configuration facilitates sliding material into the anchor aperture but resists its escape better than a simple slit gate or open anchor aperture.

Referring now to FIG. 18, this illustrates spiral gates used as apertures for inflated chambers. Three advanced aperture frameworks (18-*a*, 18-*b*, and 18-*c*) are shown with three spiral gate aperture each.

Each spiral gate aperture holds an inflatable chamber. In this case each inflatable chamber is a section of a #260 balloon which is continuous from framework 18-*a* to framework 18-*b* to framework 18-*c*. One balloon (18-*d*) has chambers which are pinched shut between the frameworks. One balloon (18-*e*) has chambers which are pinched shut at the frameworks. One balloon (18-*f*) remains essentially one chamber. All these variations are appropriate to advanced aperture framework balloon displays.

The use of single inflatable chambers as in 18-*f*, to connect different aperture frameworks is one of the innovations of this invention.

The use of continuously connected inflatable chambers as in all three balloons to connect different frameworks is another of the innovations of this invention.

Notice that the normal way for viewing such a display would be from the broad side of the balloons. This would be generally perpendicular to the plane of the three frameworks and generally perpendicular to the planes of the nine apertures. Such views are characteristic of some embodiments of advanced aperture framework balloon displays.

Notice that the plane of the balloons is generally perpendicular to the plane of the individual frameworks and generally perpendicular to the plane of the apertures. Such variation from the norm of current aperture framework balloon displays is characteristic of some embodiments of advanced aperture framework balloon displays.

Referring now to FIG. 19, this perspective view illustrates the standard alignment of end tabs for connecting two Rouse Matrix Systems™ frameworks (FIG. 19-A) and shows how they are normally connected with a cable tie (FIG. 19-B). FIG. 19-B gives an enlarged view of the section of FIG. 19-A enclosed in the outlined square. The cable tie is normally run through the corrugations near the end of the extended tab from one framework, and through the corrugations near the end of the extended tab from another framework, then through the self locking end of the cable tie. The cable tie is then pulled tightly to secure a close and relatively permanent connection between the tabs. This illustration is given to point out the savings in time and material by using the new interlocking mechanisms presented as part of this invention.

The new mechanisms do not require accessory parts nor as much time in the assembly of connections. They are also easily undone when desired.

Referring now to FIG. 20, shows a simple form of connecting end tabs by wrapping them around each other and interlocking especially configured notches.

"20-A" shows one embodiment of interlocking tabs disclosed in this application.

The notch "c-20" crosses and rests in the notch "203". The area between "c-20" and "b-20" is hidden behind the area between "203" and "202".

The notch "202" crosses and rests in the notch "b-20". The area between "202" and "201" is hidden behind the area between "b-20" and "a-20".

The notch "a" crosses and rests in the notch "201".

"20-B" shows a finished view of the interlocking tabs from above.

"20-C" shows a finished view of the interlocking tabs from the edge as indicated by the arrow.

Referring now to FIG. 21, shows the same wrapping or "spiraling" technique as FIG. 20. But with a more sophisticated notch pattern designed to more securely lock the tabs together. "21-A" shows one embodiment of interlocking tabs disclosed in this application.

The notch "c-21" crosses and rests in the notch "203". The area between "c-21" and "b-21" is hidden behind the area between "213" and "212".

The notch "212" crosses and rests in the notch "b-21". The area between "212" and "211" is hidden behind the area between "b-21" and "a-21".

The notch "a" crosses and rests in the notch "211".

"21-B" shows a finished view of the interlocking tabs from above.

"21-C" shows a finished view of the interlocking tabs from the edge as indicated by the arrow.

Referring now to FIG. 22, shows two end tabs for a "button" type connection. FIG. 22-A shows the tab with slot a-22 on the left and enlarged "button" protrusion 221 on the right. FIG. 22-B shows the assembly after 221 has been rotated and slipped through slot a-22 and then rotated back to a position parallel to its starting position. This procedure provides a reversible lock of the two tabs. FIG. 22-C shows a view of 22-B as seen from the direction of the arrow.

Referring now to FIG. 23, this show a similar arrangement as in FIG. 22. In this case both end tabs have both a slot (a-23 and b-23) and a button protrusion (231 and 232). The insertion process is the same as in FIG. 21.

Referring now to FIG. 24, this show a similar process with a slot a-24. In this case the leading end of the "male" tab (241) is inserted through the slot a-24 until the entire "hook" 242 has passed through and then the tab is rotated back to a parallel position with the hook 242 left on the bottom side of the "female" tab. FIG. 24-B shows the assembled item. FIG. 24-C shows a view as seen from the direction of the arrow.

Referring now to FIG. 25, this show a hook 251 inserted through hole a-25 and tab 252 used to hold the "male" end tab in position.

Referring now to FIG. 26, this shows two notched straps which are wrapped around each other to make a reversible lock of the two identical but rotated units.

Referring now to FIG. 27, this shows to straps with notches and tabs and illustrates them assembled.

What is claimed is:

1. A balloon display comprised of:

A. at least one framework for supporting balloons wherein each said at least one framework is comprised of material that includes a plurality of apertures and;

B. at least one first set of inflatable chambers wherein:

i said at least one first set is comprised of at least one inflatable chamber and;

ii at least one inflatable chamber of said at least one first set of inflatable chambers is at least partially inflated and;

iii at least a portion of at least one inflatable chamber of said at least one first set of inflatable chambers is circumscribed by at least one first aperture of said at least one framework and;

C. at least one second set of inflatable chambers wherein:

i said at least one second set is comprised of at least one inflatable chamber and;

ii at least one inflatable chamber of said at least one second set of inflatable chambers is at least partially inflated and;

iii at least a portion of at least one inflatable chamber of said at least one second set of inflatable chambers is circumscribed by at least one second aperture of said least one framework;

wherein said at least one first set of inflatable chambers and said at least one second set of inflatable chambers are held in their respective positions by positioning means that include one or more positioning means selected from the group consisting of:

a. at least one connector member 1. is joined by fastening means to at least one said set of inflatable chambers and 2. is joined by fastening means to at least one portion of said at least one framework;

b. at least one connector member 1. is joined by fastening means to said at least one first set of inflatable chambers and 2. is joined by fastening means to said at least one second set of inflatable chambers;

c. at least one connector member 1. is joined by fastening means to said at least one first set of inflatable chambers and 2. is joined by fastening means to said at least one second and adjacent set of inflatable chambers and 3. passes through a hole in the portion of framing material between said adjacent sets of inflatable chambers;

d. at least one connector member 1. is joined by fastening means to said at least one set of inflatable chambers by at least one first connection point and 2. extends around at least one portion of said at least one framework and 3. is joined by fastening means to the same said set of inflatable chambers by at least one second connection point;

e. at least one connector member 1. is joined by fastening means to said at least one set of inflatable chambers by at least one first connection point and 2. extends through a hole in at least one portion of said at least one framework that circumscribes said portion of at least one inflatable chamber and 3. is joined by fastening means to the same said at least one set of inflatable chambers by at least one second connection point;

f. spray adhesive 1. is in contact with at least one portion of said at least one set of inflatable chambers and 2. is in contact with at least one portion of said at least one framework;

g. adhesive other than spray adhesive 1. is in contact with at least one portion of said at least one set of inflatable chambers and 2. is in contact with at least one portion of said at least one framework;

h. at least one area of contact 1. is rough in texture and/or 2. is rough in form between said at least one set of inflatable chambers and said at least one framework;

i. at least one area of contact is defined within multiple planes between said at least one set of inflatable chambers and said at least one framework;

j. elastic matter 1. is part of said at least one framework and 2. causes pressure to be applied to said at least a portion of said at least one inflatable chamber of said at least one set of inflatable chambers.

2. The balloon display as recited in claim 1, further comprising at least one set of inflatable chambers being held in its respective position by positioning means that additionally include the pneumatic pressure of at least one inflatable chamber of said at least one set of inflatable chambers expanding outward against a circumscribing portion of said at least one framework.

3. The balloon display as recited in claim 1, further comprising at least one break or gap in the material defining said hole used for the passage of said connector member; said break or gap being sufficient for said connector member to be inserted into said hole through said break or gap.

4. The balloon display as recited in claim 3, further comprising said break or gap being configured such that said break or gap is resistant to said connector member exiting said hole through said break or gap.

5. The balloon display as recited in claim 1, further comprising said at least one connector member being at least one neck, stem, tab, protrusion or other extension of the material forming said set of inflatable chambers.

6. A balloon display comprised of:

A. At least one framework for supporting balloons wherein:

i each said at least one framework is comprised of material that includes a plurality of apertures and;

ii at least one of said plurality of apertures is formed of framing elements that are joined with interlocking tabs and;

B. at least one first set of inflatable chambers wherein:

i said at least one first set is comprised of at least one inflatable chamber and;

ii at least one inflatable chamber of said at least one first set of inflatable chambers is at least partially inflated and;

iii at least a portion of at least one inflatable chamber of said at least one first set of inflatable chambers is circumscribed by at least one first aperture of said least one framework and;

C. at least one second set of inflatable chambers wherein:

i said at least one second set is comprised of at least one inflatable chamber and;

ii at least one inflatable chamber of said at least one second set of inflatable chambers is at least partially inflated and;

iii at least a portion of at least one inflatable chamber of said at least one second set of inflatable chambers is circumscribed by at least one second aperture of said least one framework;

wherein said at least one first set of inflatable chambers and said at least one second set of inflatable chambers are held in their respective positions by positioning means that include one or more positioning means selected from the group consisting of:

a. at least one connector member
1. is joined by fastening means to at least one said set of inflatable chambers and
2. is joined by fastening means to at least one portion of said at least one framework;

b. at least one connector member
1. is joined by fastening means to said at least one first set of inflatable chambers and
2. is joined by fastening means to said at least one second set of inflatable chambers;

c. at least one connector member
1. is joined by fastening means to said at least one first set of inflatable chambers and
2. is joined by fastening means to said at least one second and adjacent set of inflatable chambers and
3. passes through a hole in the portion of framing material between said adjacent sets of inflatable chambers;

d. at least one connector member
1. is joined by fastening means to said at least one set of inflatable chambers by at least one first connection point and
2. extends around at least one portion of said at least one framework and
3. is joined by fastening means to the same said set of inflatable chambers by at least one second connection point;

e. at least one connector member
1. is joined by fastening means to said at least one set of inflatable chambers by at least one first connection point and
2. extends through a hole in at least one portion of said at least one framework that circumscribes said portion of at least one inflatable chamber and
3. is joined by fastening means to the same said at least one set of inflatable chambers by at least one second connection point;

f. spray adhesive
1. is in contact with at least one portion of said at least one set of inflatable chambers and
2. is in contact with at least one portion of said at least one framework;

g. adhesive other than spray adhesive
1. is in contact with at least one portion of said at least one set of inflatable chambers and
2. is in contact with at least one portion of said at least one framework;

h. at least one area of contact
1. is rough in texture and/or
2. is rough in form between said at least one set of inflatable chambers and said at least one framework;

i. at least one area of contact is defined within multiple planes between said at least one set of inflatable chambers and said at least one framework;

j. elastic matter
1. is part of said at least one framework and
2. causes pressure to be applied to said at least a portion of said at least one inflatable chamber of said at least one set of inflatable chambers.

7. The balloon display as recited in claim 6, further comprising at least one set of inflatable chambers being held in its respective position by positioning means that additionally include the pneumatic pressure of at least one inflatable chamber of said at least one set of inflatable chambers expanding outward against a circumscribing portion of said at least one framework.

8. The balloon display as recited in claim 6, further comprising:

A. at least two said interlocking tabs with at least three exposed edges comprising:
i. at least one end edge and;
ii. at least two side edges and;
iii. at least three notches in a series along said side edges including at least one notch that is preceded and followed by a notch that is on an opposing side edge and;

B. at least one of said at least two said interlocking tabs being attached to at least one first framing element and;

C. at least one of said at least two said interlocking tabs being attached to at least one second framing element and;

D. said interlocking tab attached to said at least one first framing element being wrapped around said interlocking tab attached to said at least one second framing element such that notches of wrapped tabs fit together.

9. The balloon display as recited in claim 6, further comprising at least two said interlocking tabs including:

A. at least one first said interlocking tab attached to at least one first framing element and having within its borders an aperture and;

B. at least one second said interlocking tab attached to at least one second framing element and having a bulbous end or protrusion;

C. said bulbous end being passed through said aperture and;

D. said bulbous end being configured and positioned such that said bulbous end is resistant to passing back through said aperture.

10. The balloon display as recited in claim 6, further comprising at least one break or gap in the material defining said hole used for the passage of said connector member; said break or gap being sufficient for said connector member to be inserted into said hole through said break or gap.

11. The balloon display as recited in claim 10, further comprising said break or gap being configured such that said break or gap is resistant to said connector member exiting said hole through said break or gap.

12. The balloon display as recited in claim 6, further comprising said at least one connector member being at least one neck, stem, tab, protrusion or other extension of the material forming said set of inflatable chambers.

13. A balloon display comprising:

A. a plurality of frameworks for supporting balloons wherein at least two frameworks of said plurality of frameworks is comprised of material that includes a plurality of apertures and;

B. at least one first set of inflatable chambers wherein:
i said at least one first set is comprised of at least one inflatable chamber and;
ii at least one inflatable chamber of said at least one first set of inflatable chambers is at least partially inflated and;

iii at least a portion of at least one inflatable chamber of said at least one first set of inflatable chambers is circumscribed by at least one first aperture of said at least two frameworks and;

C. at least one second set of inflatable chambers wherein:

i said at least one second set is comprised of at least one inflatable chamber and;

ii at least one inflatable chamber of said at least one second set of inflatable chambers is at least partially inflated and;

iii at least a portion of at least one inflatable chamber of said at least one second set of inflatable chambers is circumscribed by at least one second aperture of said at least two frameworks;

wherein said at least one first set of inflatable chambers and said at least one second set of inflatable chambers are held in their respective positions by positioning means that include one or more positioning means selected from the group consisting of:

a. at least one connector member 1. is joined by fastening means to at least one said set of inflatable chambers and
2. is joined by fastening means to at least one portion of said at least two frameworks;

b. at least one connector member 1. is joined by fastening means to said at least one first set of inflatable chambers and
2. is joined by fastening means to said at least one second set of inflatable chambers;

c. at least one connector member 1. is joined by fastening means to said at least one first set of inflatable chambers and
2. is joined by fastening means to said at least one second and adjacent set of inflatable chambers and
3. passes through a hole in the portion of framing material between said adjacent sets of inflatable chambers;

d. at least one connector member 1. is joined by fastening means to said at least one set of inflatable chambers by at least one first connection point and
2. extends around at least one portion of said at least two frameworks and
3. is joined by fastening means to the same said set of inflatable chambers by at least one second connection point;

e. at least one connector member 1. is joined by fastening means to said at least one set of inflatable chambers by at least one first connection point and
2. extends through a hole in at least one portion of said at least two frameworks that circumscribes said portion of at least one inflatable chamber and
3. is joined by fastening means to the same said at least one set of inflatable chambers by at least one second connection point;

f. spray adhesive 1. is in contact with at least one portion of said at least one set of inflatable chambers and
2. is in contact with at least one portion of said at least two frameworks;

g. adhesive other than spray adhesive 1. is in contact with at least one portion of said at least one set of inflatable chambers and
2. is in contact with at least one portion of said at least two frameworks;

h. at least one area of contact 1. is rough in texture and/or
2. is rough in form between said at least one set of inflatable chambers and said at least two frameworks;

i. at least one area of contact is defined within multiple planes between said at least one set of inflatable chambers and said at least two frameworks;

j. elastic matter 1. is part of said at least two frameworks and
2. causes pressure to be applied to said at least a portion of said at least one inflatable chamber of said at least one set of inflatable chambers and;

wherein said at least two frameworks are connected with connection means that include one or more connection means selected from the group consisting of:

a. a first framework of said at least two frameworks and a second framework of said at least two frameworks are joined by fastening means to a common said set of inflatable chambers;

b. a first framework of said at least two frameworks is joined by fastening means to a first said set of inflatable chambers and a second framework of said at least two frameworks is joined by fastening means to a second said set of inflatable chambers and said first said set of inflatable chambers and said second said set of inflatable chambers are joined by fastening means;

c. at least one neck, stem, tab, protrusion or other portion of said at least one set of inflatable chambers is connected by fastening means to said at least two frameworks;

d. at least one tab extension of a first framework of said at least two frameworks connects by fastening means to a second framework of said at least two frameworks;

e. at least one tab extension of a first framework of said at least two frameworks connects by fastening means to at least one tab extension of a second framework of said at least two frameworks.

14. The balloon display as recited in claim 13, further comprising:

A. at least two said tab extensions with at least three exposed edges comprising:

i at least one end edge and at least two side edges and;

ii at least three notches in a series along said side edges including at least one notch that is preceded and followed by a notch that is on an opposing side edge and;

B. at least one of said at least two said tab extensions being attached to at least one first framework and;

C. at least one of said at least two said tab extensions being attached to at least one second framework and;

D. said tab extension attached to said at least one first framework being wrapped around said tab extension attached to said at least one second framework such that notches of wrapped tabs fit together.

15. The balloon display as recited in claim 13, further comprising a set of at least two interlocking tab extensions wherein:

A. a first said tab extension is attached to at least one first framework and has within its borders an aperture and;

B. a second said tab extension is attached to at least one second framework and has a bulbous end or protrusion and;

C. said bulbous end being passed through said aperture and;

D. said bulbous end being configured and positioned such that said bulbous end is resistant to passing back through said aperture.

16. The balloon display as recited in claim 13, further comprising interlocking straps said straps incorporating matched sets of notches and/or slits that may be nested to hold one strap to another at predetermined intervals.

17. The balloon display as recited in claim 13, further comprising a portion of at least one said set of inflatable chambers that wraps around overlapping portions of said at least two frameworks.

18. The balloon display as recited in claim 13, further comprising at least one set of inflatable chambers being held in its respective position by positioning means that additionally include the pneumatic pressure of at least one inflatable chamber of said at least one set of inflatable chambers expanding outward against a circumscribing portion of said at least two frameworks.

19. The balloon display as recited in claim 13, further comprising at least one break or gap in the material defining said hole used for the passage of said connector member; said break or gap being sufficient for said connector member to be inserted into said hole through said break or gap.

20. The balloon display as recited in claim 13, further comprising said at least one connector member being at least one neck, stem, tab, protrusion or other extension of the material forming said set of inflatable chambers.

* * * * *